US011180274B2

(12) United States Patent
Nelson et al.

(10) Patent No.: US 11,180,274 B2
(45) Date of Patent: Nov. 23, 2021

(54) ELONGATED OBJECT LABELING DEVICE

(71) Applicant: Panduit Corp., Tinley Park, IL (US)

(72) Inventors: Kevin L. Nelson, Cumming, GA (US); Marc R. Obenshain, Cumming, GA (US)

(73) Assignee: Panduit Corp., Tinley Park, IL (US)

( * ) Notice: Subject to any disclaimer, the term of this patent is extended or adjusted under 35 U.S.C. 154(b) by 298 days.

(21) Appl. No.: 16/279,298

(22) Filed: Feb. 19, 2019

(65) Prior Publication Data

US 2019/0263552 A1 Aug. 29, 2019

Related U.S. Application Data

(60) Provisional application No. 62/634,279, filed on Feb. 23, 2018.

(51) Int. Cl.

| | |
|---|---|
| ***B65C 3/00*** | (2006.01) |
| ***B65C 9/00*** | (2006.01) |
| ***B65C 3/02*** | (2006.01) |
| ***B65C 9/30*** | (2006.01) |

(52) U.S. Cl.
CPC . *B65C 3/02* (2013.01); *B65C 9/30* (2013.01)

(58) Field of Classification Search
CPC .... B65C 3/00; B65C 3/02; B65C 9/00; B65C 9/30
See application file for complete search history.

(56) References Cited

U.S. PATENT DOCUMENTS

| | | | |
|---|---|---|---|
| 3,245,860 | A | 4/1966 | Aurich et al. |
| 3,337,103 | A | 8/1967 | Walus et al. |
| 4,944,829 | A | 7/1990 | Tuttle et al. |
| 6,742,858 | B2 | 6/2004 | Lehmkuhl et al. |
| 6,875,304 | B2 | 4/2005 | Schanke et al. |
| 7,178,572 | B2 | 2/2007 | Schanke et al. |
| 7,231,952 | B2 | 6/2007 | Schanke et al. |
| 7,469,736 | B2 | 12/2008 | Fries et al. |
| 7,717,149 | B2 | 5/2010 | Johnson |
| 7,757,739 | B2 | 7/2010 | Fries et al. |
| 8,033,312 | B2 | 10/2011 | Fries et al. |
| 8,186,408 | B2 | 5/2012 | Fries et al. |

(Continued)

FOREIGN PATENT DOCUMENTS

| | | | |
|---|---|---|---|
| EP | 1832519 | A1 | 9/2007 |
| FR | 2600306 | A1 | 12/1987 |
| WO | 8801247 | A1 | 2/1988 |

*Primary Examiner* — Jacob T Minskey
*Assistant Examiner* — Matthew Hoover
(74) *Attorney, Agent, or Firm* — Christopher S. Clancy; James H. Williams; Peter S. Lee

(57) ABSTRACT

An elongated object label applicator has a driver operably connected to a wrapping mechanism. The wrapping mechanism has a plurality of guide rollers spaced about a central portion. A belt is tensioned around the guide rollers and across an opening in the central portion through which an object to labeled is received. The belt is deflectable against an elastic force such that the belt can be recessed with the central portion by a force provided by the object to be labeled. The wrapping mechanism is driven by the driver to rotate the guide rollers about an axis of rotation of the wrapping mechanism passing through the central portion. The wrapping mechanism orbits the object to be labeled located within the central portion.

8 Claims, 28 Drawing Sheets

(56) References Cited

U.S. PATENT DOCUMENTS

| | | | | |
|---|---|---|---|---|
| 8,545,666 | B2 | 10/2013 | Grove | |
| 8,783,318 | B2 * | 7/2014 | Witkiewicz | B65C 9/32 156/443 |
| 8,826,960 | B1 | 9/2014 | Bennett et al. | |
| 8,905,108 | B2 * | 12/2014 | Brooks | B65C 9/12 156/538 |
| 9,321,548 | B1 * | 4/2016 | Bennett | G09F 3/0295 |
| 9,409,668 | B1 | 8/2016 | Brooks | |
| 9,446,877 | B1 | 9/2016 | Bennett et al. | |
| 9,452,856 | B1 | 9/2016 | Brooks | |

* cited by examiner

ELONGATED OBJECT LABELING DEVICE

CROSS-REFERENCE TO RELATED APPLICATIONS

This application claims priority to U.S. Provisional Application No. 62/634,279, filed Feb. 23, 2018, the subject matter of which is hereby incorporated by reference in its entirety.

TECHNICAL FIELD

The invention relates to labeling of elongated objects; more particularly, the invention relates to labelers for wrapping labels about wires, cables, and the like.

BACKGROUND

Labeling of wires and cables has traditionally been accomplished manually or by way of apparatuses requiring cumbersome, noisy hydraulic or high-pressure air lines. Various such apparatuses have been developed. Typically, such machines grasp two ends of a section of the wire and pull this section of wire taut. Once the wire is pulled taut, a label applicator or platform orbits around the taut section of wire to apply the label to the wire. This labeler must be capable of orbiting around the wire while applying an appropriate amount and type of pressure between the labeler and the wire. Because the wire or object to be wrapped may take on various shapes or sizes, this can complicate the design and operation of such wire labelers.

It follows that wire labeling apparatuses are typically complex in terms of parts and operation. Separate components are necessary for straightening, centering, and clamping. Moreover, sufficient space must be allotted in the machine to accommodate the orbiting of the label applicator about the wire. Frequently, this means the use of such wire wrappers are limited to immovable fixtures or devices that are not well-adapted for portable use.

Many of the currently available labeling devices are cumbersome, complex and slow. These apparatuses typically deliver discrete labels from a roll. More efficient, faster labeling options require lamination of printed film and adhesive tape on the apparatus.

The present invention is provided to solve the problems discussed above and other problems, and to provide advantages and aspects not provided by prior labeling devices of this type. A full discussion of the features and advantages of the present invention is deferred to the following detailed description, which proceeds with reference to the accompanying drawings.

SUMMARY

A first aspect of the invention is directed to an elongated object label applicator. The applicator comprises a first driver and a wrapping mechanism. The wrapping mechanism comprises a plurality of guide rollers spaced about a central portion. A belt is tensioned around the guide rollers and across an opening in the central portion through which an object to be labeled is received. The belt is deflectable against an elastic force such that the belt can be recessed within the central portion by a force provide by the object to be labeled. The wrapping mechanism is driven by the first driver to rotate the guide rollers about an axis of rotation of the wrapping mechanism passing through the central portion wherein the wrapping mechanism orbits the object to be labeled located within the central portion.

This aspect may include one or more of the following features. The belt is freewheeling about the guide rollers. The opening is defined between a first guide roller in the plurality of guide rollers spaced across the opening from a second guide roller in the plurality of guide rollers. A third guide roller in the plurality of guide rollers is located between the first and second guide rollers and opposite the opening. The third guide roller is elastically mounted to the wrapping mechanism wherein the third guide roller is movable under a force provided by engagement between the belt and the object to be labeled which deflects the belt within the central portion of the wrapping mechanism. A fourth guide roller in the plurality of guide rollers is located between the first and second guide rollers and opposite the opening. The fourth guide roller is elastically mounted to the wrapping mechanism wherein the fourth guide roller is movable under a force provided by engagement between the belt and the object to be labeled which deflects the belt within the central portion of the wrapping mechanism.

The first aspect of the invention may further comprise an incoming conveyor driven by a conveyor driver. The incoming conveyor is in operable alignment with the wrapping mechanism wherein a label traveling on the incoming conveyor is delivered to the wrapping mechanism.

The first aspect of the invention may further comprise a conveyor assist lever actuated by the conveyor driver to operably engage the incoming conveyor and form a nip therewith through which the label travels to the wrapping mechanism.

The first aspect of the invention may further comprise an object lift mechanism comprising a cradle movable between a home position wherein the object to be labeled is loaded onto the cradle and wrap position where the object to be labeled is located within the central portion of the wrapping mechanism.

The first aspect of the invention may further comprise a suction system comprising a vacuum source connected by a duct to a position adjacent the incoming conveyor wherein a vacuum force provided by the vacuum source urges the label against the incoming conveyor to retain the label to the incoming conveyor.

A second aspect of the invention is directed to an elongated object label applicator. The applicator comprises a wrapping mechanism, an incoming conveyor, and a conveyor lift mechanism. The wrapping mechanism has a recessed central portion configured to receive an elongated object therein. The wrapping mechanism is rotatable about an axis of rotation passing through the central portion wherein the wrapping mechanism orbits an object to be labeled located within the central portion. The incoming conveyor is driven by a conveyor driver to deliver a label to the wrapping mechanism. The incoming conveyor is in operable alignment with the wrapping mechanism wherein a label traveling on the incoming conveyor is delivered to the wrapping mechanism. The conveyor assist lever is actuated by the conveyor driver to operably engage the incoming conveyor and form a nip therewith through which the label travels to the wrapping mechanism.

This aspect may include one or more of the following features. Activation of the conveyor driver causes the conveyor assist lever to engage the incoming conveyor. A force provided by the conveyor assist lever against incoming conveyor is regulated by a damper located between the conveyor driver the conveyor assist lever. The damper is a viscous damper.

The second aspect of the invention may further comprise a source of printed labels in operable alignment with the incoming conveyor wherein the incoming conveyor receives printed labels from the source of printed labels.

The first aspect of the invention may further comprise an object lift mechanism comprising a cradle movable between a home position where the object to be labeled is loaded onto the cradle and wrap position where the object to be labeled is located within the central portion of the wrapping mechanism.

The first aspect of the invention may further comprise a suction system comprising a vacuum source connected by a duct to a position adjacent the incoming conveyor wherein a vacuum force provided by the vacuum source urges the label against the incoming conveyor to retain the label to the incoming conveyor.

A third aspect of the invention is directed to an elongated object label applicator. The applicator comprises a wrapping mechanism, an incoming conveyor, and an object lift mechanism. The wrapping mechanism has a recessed central portion configured to receive an elongated object therein. The wrapping mechanism is rotatable about an axis of rotation passing through the central portion wherein the wrapping mechanism orbits an object to be labeled located within the central portion. The incoming conveyor is driven by a conveyor driver. The incoming conveyor is in operable alignment with the wrapping mechanism wherein a label traveling on the incoming conveyor is delivered to the wrapping mechanism. The object lift mechanism comprises a cradle that is movable between a home position wherein the object to be labeled is loaded onto the cradle and wrap position where the object to be labeled is located within the central portion of the wrapping mechanism.

The third aspect of the invention may further comprise a suction system comprising a vacuum source connected by a duct to a position adjacent the incoming conveyor wherein a vacuum force provided by the vacuum source urges the label against the incoming conveyor to retain the label to the incoming conveyor.

The third aspect of the invention may further comprise a source of printed labels in operable alignment with the incoming conveyor wherein the incoming conveyor receives printed labels from the source of printed labels.

The third aspect of the invention may further comprise a conveyor assist lever actuated by the driver to operably engage the incoming conveyor and form a nip therewith through which the label travels to the wrapping mechanism.

A fourth aspect of the invention is directed to an elongated object label applicator. The applicator comprises a first driver, a wrapping mechanism, an incoming conveyor, a conveyor assist lever, a conveyor lift mechanism, and a suction system. The wrapping mechanism comprises a plurality of guide rollers spaced about a central portion. A belt is tensioned around the guide rollers and across an opening in the central portion through which an object to be labeled is received. The belt is deflectable against an elastic force such that the belt can be recessed with the central portion by a force provide by the object to be labeled. The wrapping mechanism is driven by the first driver to rotate the guide rollers simultaneously about an axis of rotation of the wrapping mechanism passing through the central portion wherein the wrapping mechanism orbits the object to be labeled located within the central portion. The incoming conveyor is driven by a conveyor driver to deliver a label to the wrapping mechanism. The incoming conveyor is in operable alignment with the wrapping mechanism wherein a label traveling on the incoming conveyor is delivered to the wrapping mechanism. The conveyor assist lever is actuated by the conveyor driver to operably engage the incoming conveyor and form a nip therewith through which the label travels to the wrapping mechanism. The object lift mechanism comprises a cradle movable between a home position where the object to be labeled is loaded onto the cradle and a wrap position where the object to be labeled is located within the central portion of the wrapping mechanism. The suction system comprises a vacuum source connected by a duct to a position adjacent the incoming conveyor wherein a vacuum force provided by the vacuum source urges the label against the incoming conveyor to retain the label to the incoming conveyor.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figures 1, 1A:
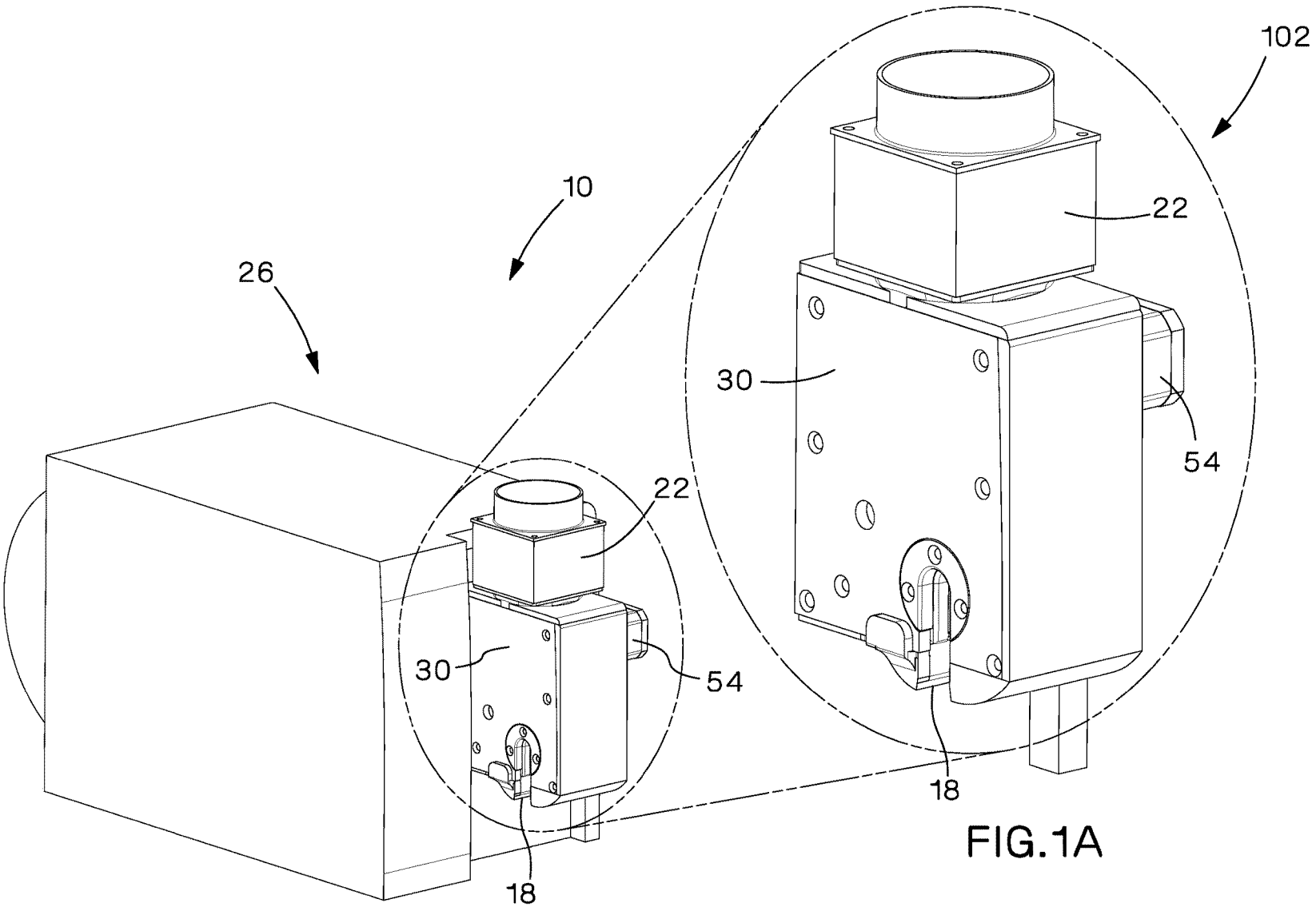
FIG. 1 is a perspective view of an apparatus of the present invention.
FIG. 1A is a perspective view of a portion of the apparatus of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring generally to the figures, automated apparatuses for applying printed labels to wires, cables or other elongated objects of varying diameters are illustrated. Labels are wrapped around the objects without spinning the objects about their elongated longitudinal axes. The apparatuses are particularly useful for label types that require that the label be wrapped around an object using more than one revolution. Self-laminating labels are one such type, requiring a transparent end of the label to be wrapped over top of a printed region to provide protection to the printed content.

The following description utilizes the following drawing conventions. Elements of a first embodiment are given reference numbers less than 1000; elements of a second embodiment are given reference numbers between 1000 and 1999; elements of a third embodiment are given reference numbers between 2000 and 2999, and so on. The last three digits of the reference numbers given to elements of the second, third, fourth embodiments, etc. correspond to the reference numbers given the same elements of the first embodiment where applicable. In each case, the last three digits of each embodiment correspond to like elements in the other embodiments. Movement of various elements is shown by arrows.

Figure 2:
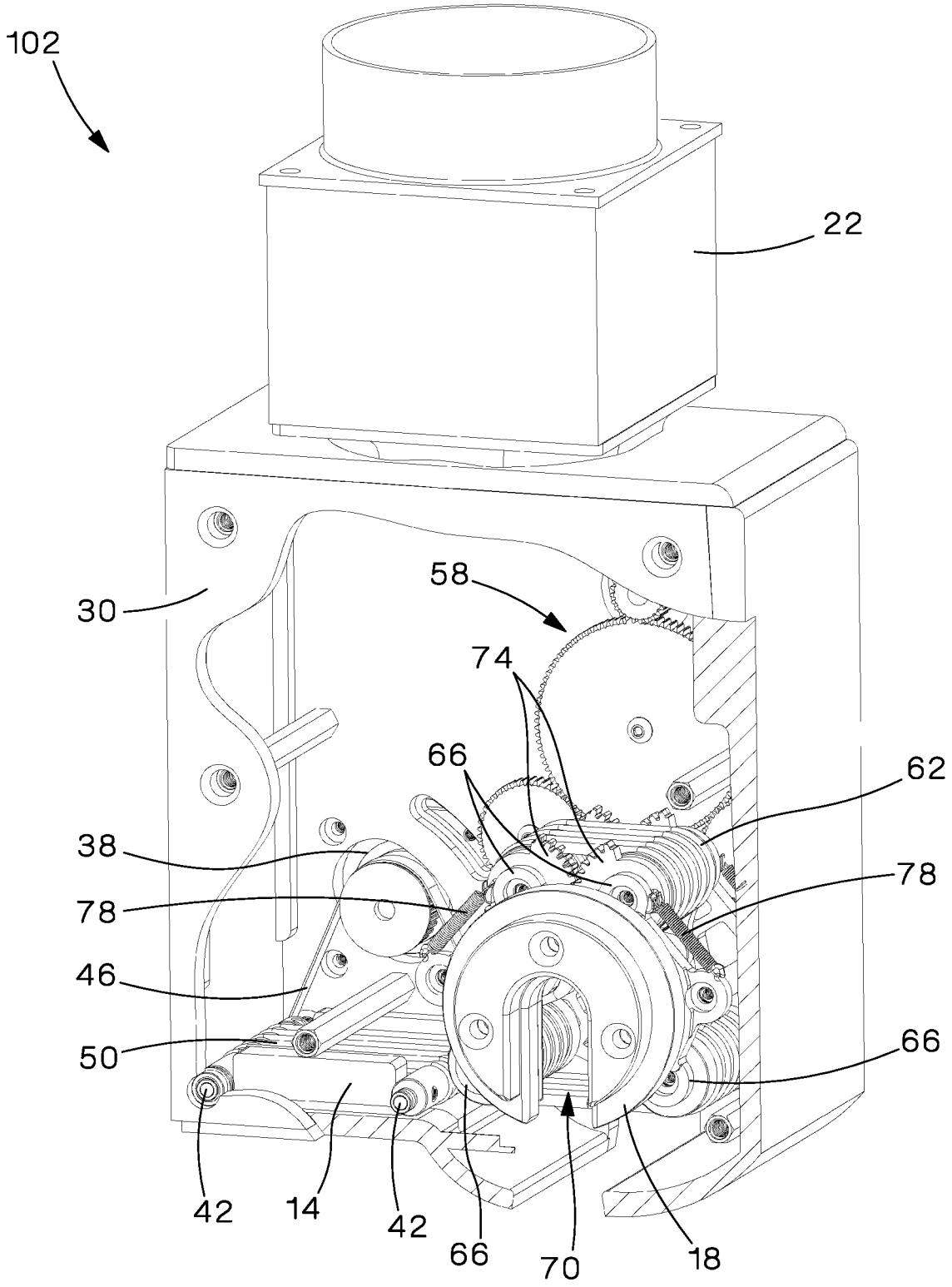
FIG. 2 is a perspective view of a label applicator.

Referring to FIGS. 1-12, a label applicator 10 comprises several sub-systems. These include an incoming conveyor 14, a wrapping mechanism 18, and a suction system 22, as shown in FIG. 2.

In an embodiment of the invention, the subsystems 14, 18, 22 are attached to desktop label printer 26 connected via support plates 30. Any appropriate fastener may be used to attach the subsystems 14,18,22 to the label printer 26, such as bolts, screws, welds, clamps, etc.

Figure 3:
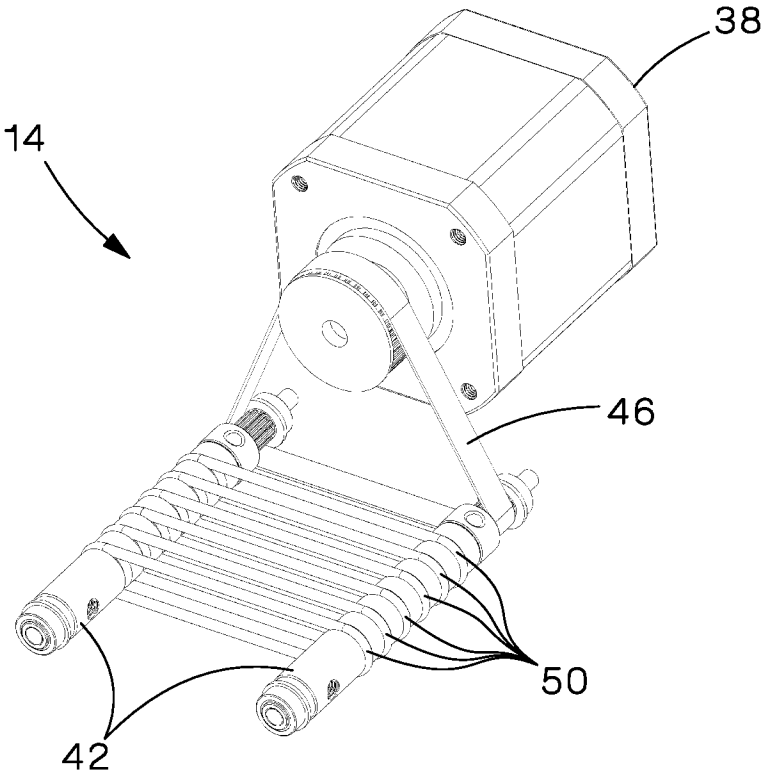
FIG. 3 is a perspective view of an incoming conveyor.
Figure 5:
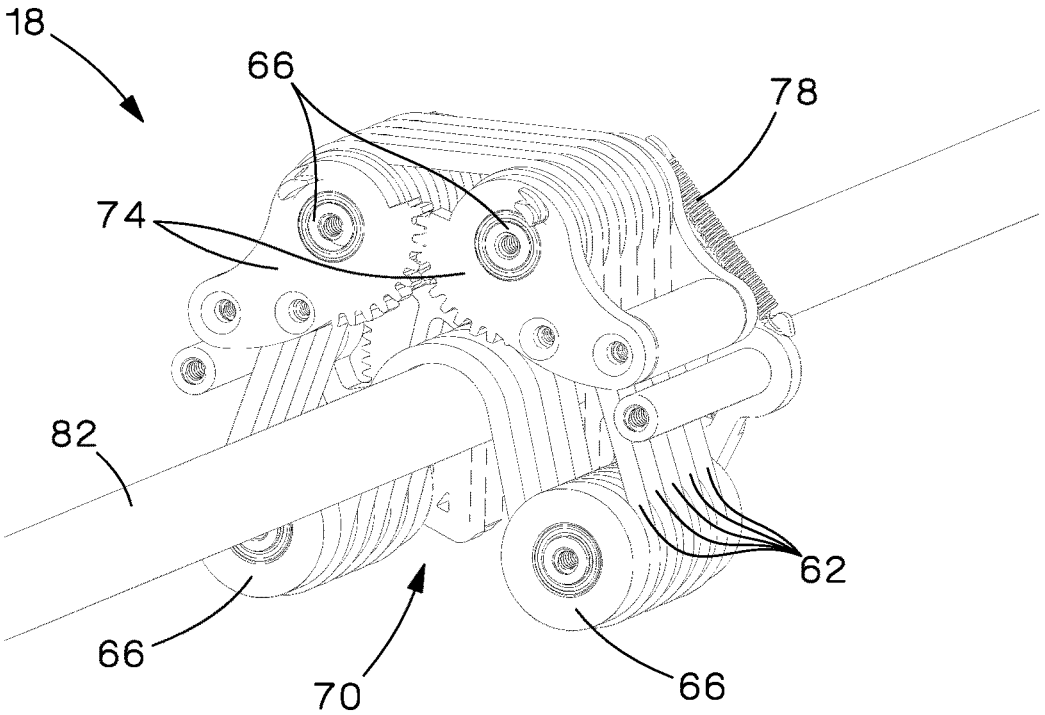
FIG. 5 is a perspective view of a wrapping mechanism.
Figure 6:
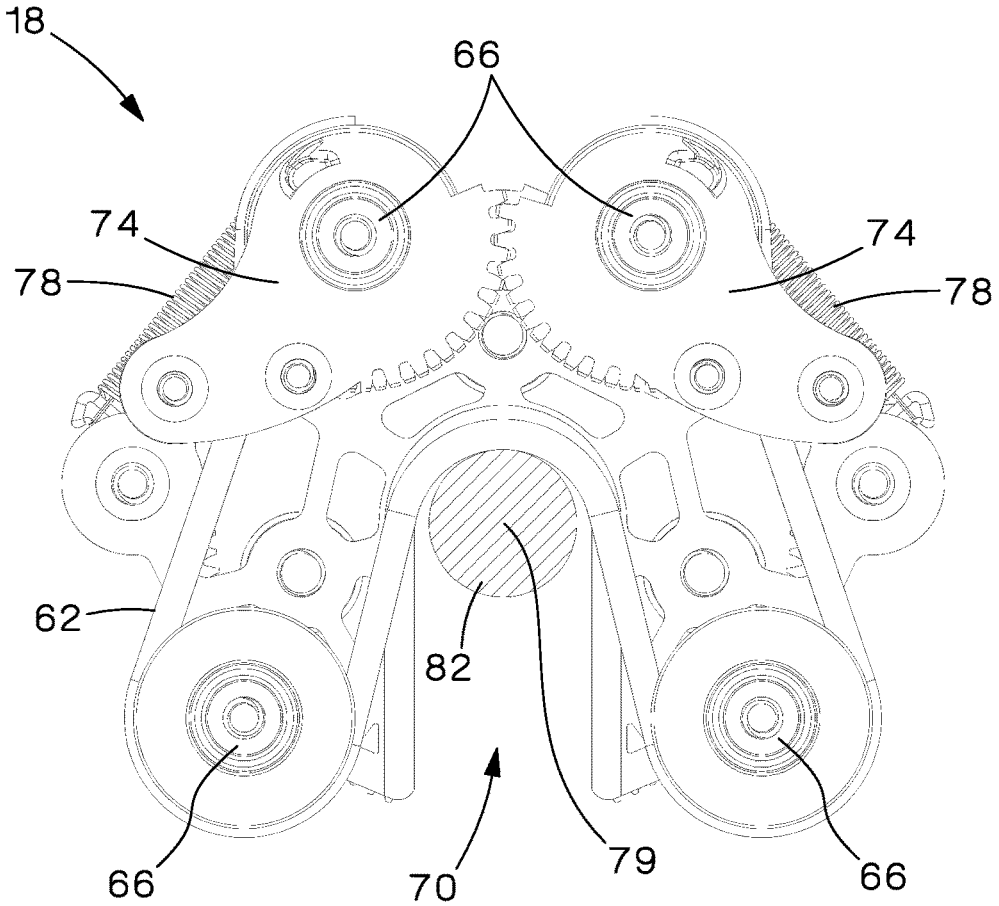
FIG. 6 is a side view of a wrapping mechanism.
Figure 7:
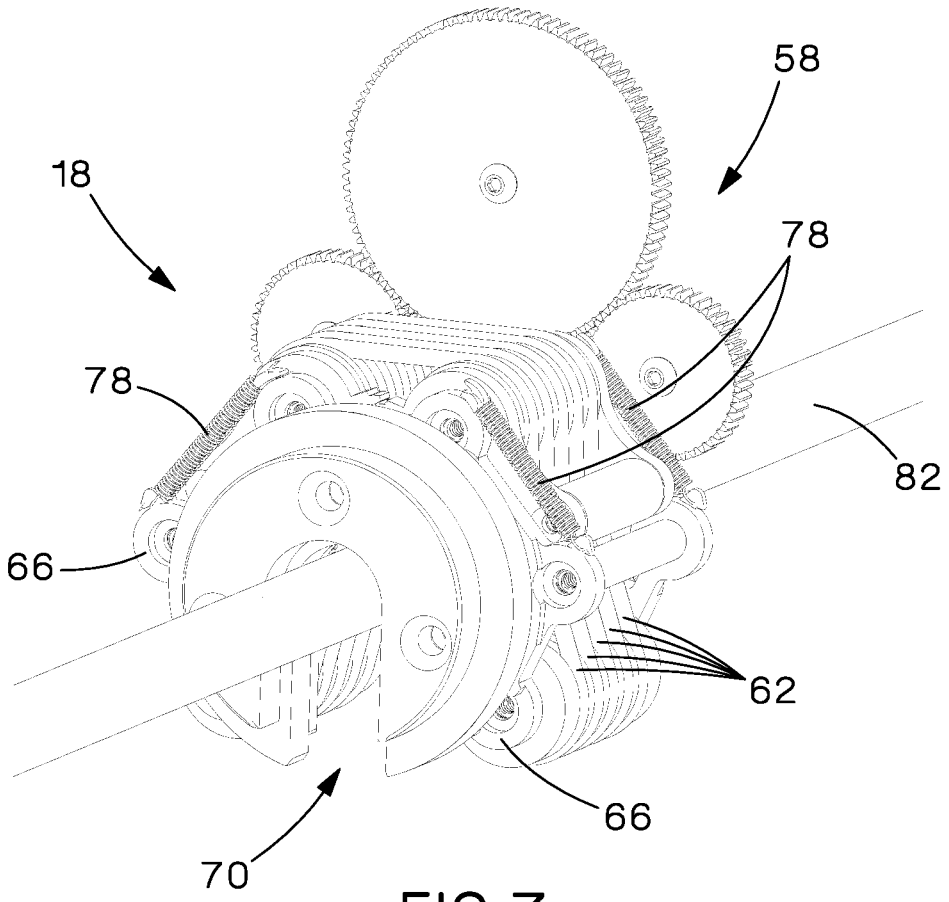
FIG. 7 is a perspective view of a wrapping mechanism.

Referring to FIG. 3, the incoming conveyor 14 provides a movement to labels from a label peel-and-present mechanism 34 (see FIG. 8) to the wrapping mechanism 18. The incoming conveyor 14 comprises a driver, such as a hand crank, air cylinder, rack and pinion, etc., but preferably a motor 38. The driver is connected to two or more shafts 42 using a drive belt 46 and belts 50 to rotate the shafts 42 at the same rate. The shafts 42 span an opening between the support plates 30 and a series of belts 50 spaced with gaps between them (alternatively, a single belt with holes through it) are held in tension around the shafts 42.

Figure 4:
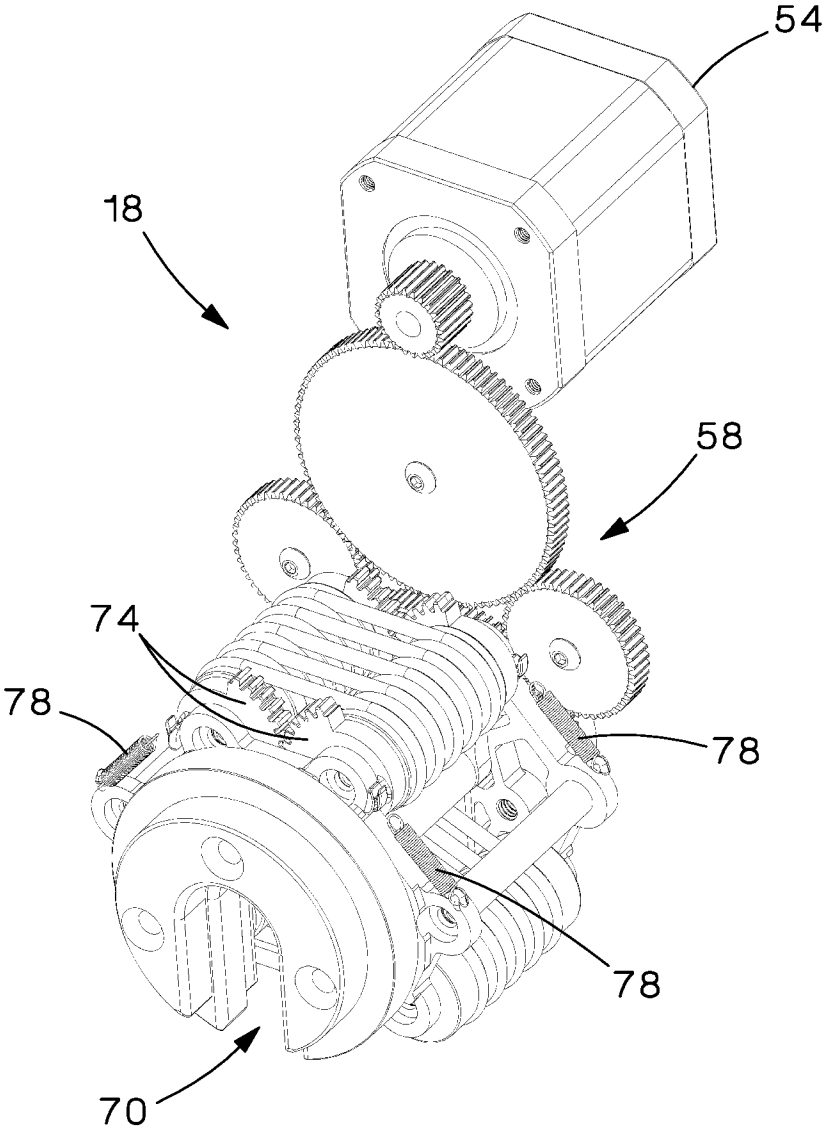
FIG. 4 is a perspective view of a wrapping mechanism.

The wrapping mechanism 18 is illustrated in FIG. 4. It is generally a rotational device driven by a driver, such as a motor 54, and gear train 58 (alternatively, a belt or a chain) and is further detailed in FIGS. 5-7. The wrapping mechanism 18 has a belt system 62 of similar construction to the incoming conveyor 14. The wrapping mechanism 18 includes a plurality of guide rollers 66, here four, that provide a primary guidance for the belts 62.

The rollers 66 are spaced about a perimeter of the wrapping mechanism 18 so that a central portion 70 of the wrapping mechanism 18 is free from the guide rollers 66. A first pair of the rollers 66 is supported between tensioner arms 74 that are held in tension with extension springs 78. The tensioner arms remove slack in the belts 62 and keep the belts 62 straight and taught and allow the belts 62 to be moved or pushed into the central portion 70 by the object 82 to be wrapped.

For example, the object 82 is inserted into the wrapping mechanism 18 and forces the belts 62 within the central portion 70 against a tension of the springs 78 until the object 82 reaches approximately a center of the wrapping mechanism's rotational axis 79. The belts 62 together with the rollers 66 rotate 1 or more times, so that a surface of the belts 62 travels along the full circumference of the object 82. The belts 62 push against a surface of the object 82 with the tension provided by the tensioner arms 74. While the wrapping mechanism 18 is being rotated, the belts 66 are driven by the contact/engagement between the belt surface and the object 82 that was inserted into the wrapping mechanism 18.

Rotation of the wrapping mechanism 18 is accomplished by the gear train 58 (FIG. 4) or other suitable drive mechanism.

Figure 8:
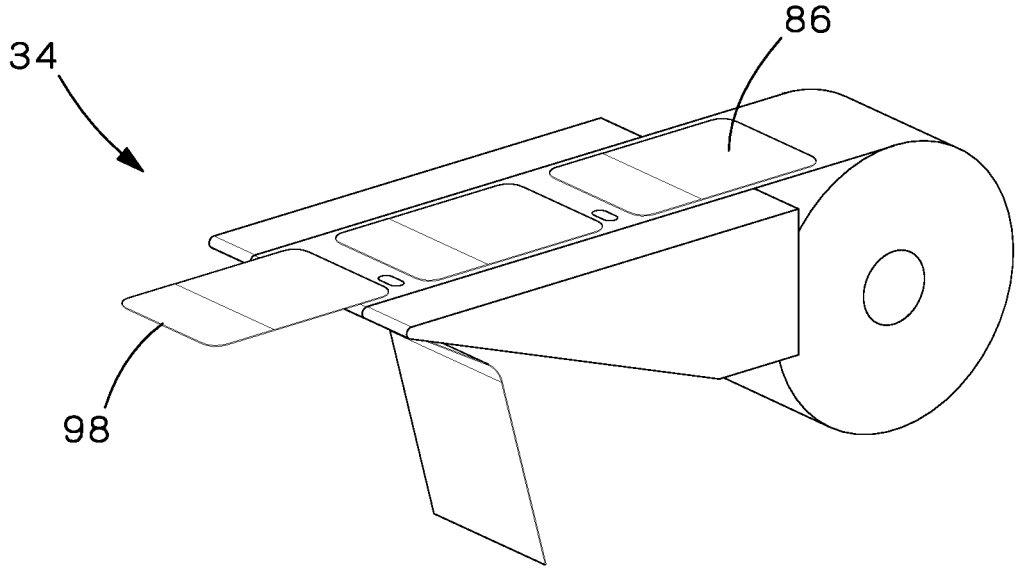
FIG. 8 is a perspective view of a label peel-and-present mechanism.

The subsystems 14, 18, 22 work together to control and transport labels 86 presented to the label applicator from a label peel-and-present mechanism 34 that is independent of the label applicator 10. A typical peel-and-present mechanism 34 is depicted in FIG. 8; however, the mechanism 34 could be a stand-alone device with pre-printed media or attached to the output of a desktop label printer 26.

Figure 9:
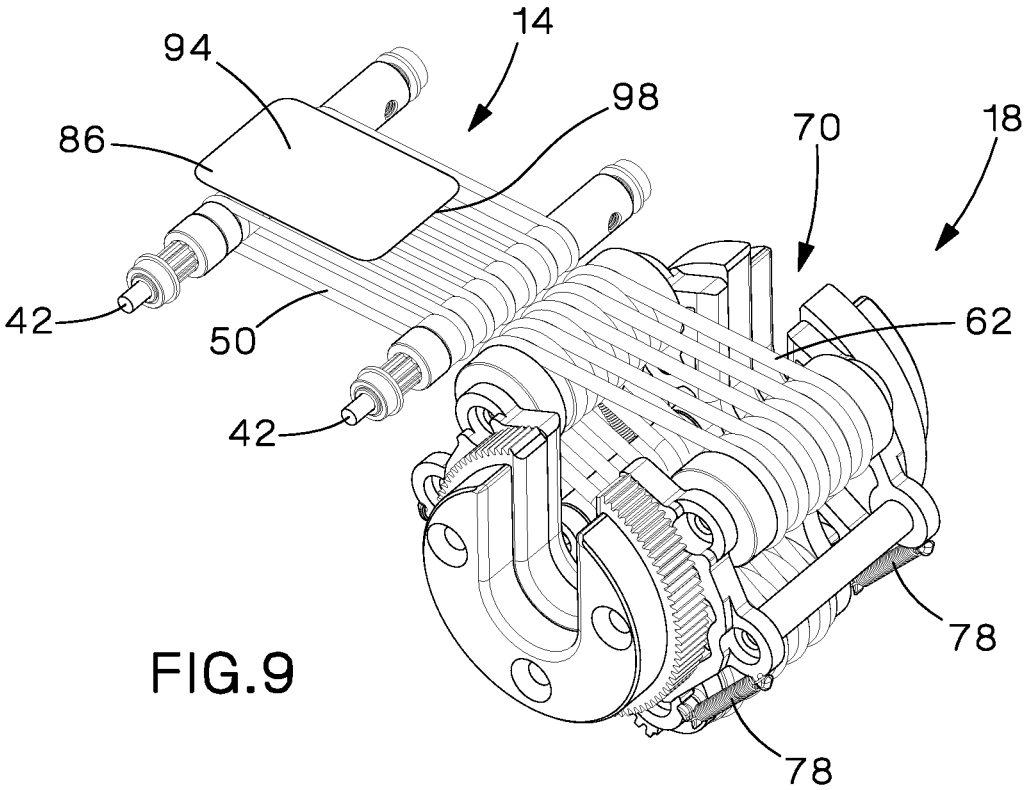
FIG. 9 is a first stage in a label applicator method.
Figure 10:
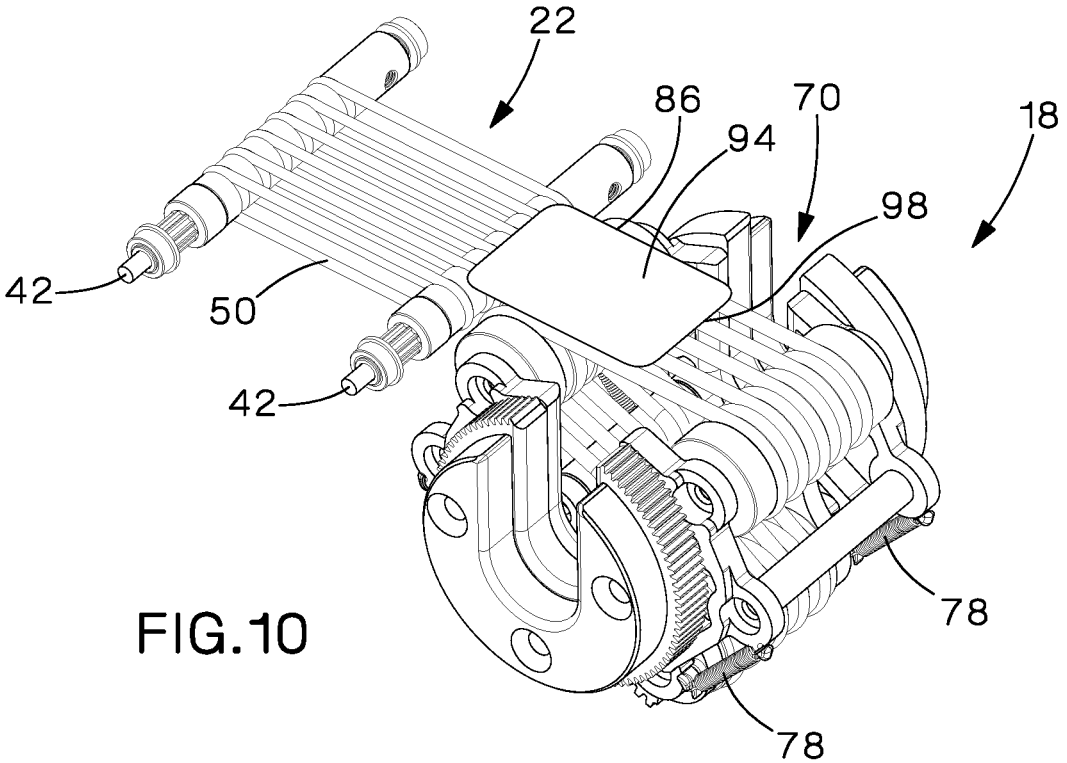
FIG. 10 is a second stage in a label applicator method.
Figure 11:
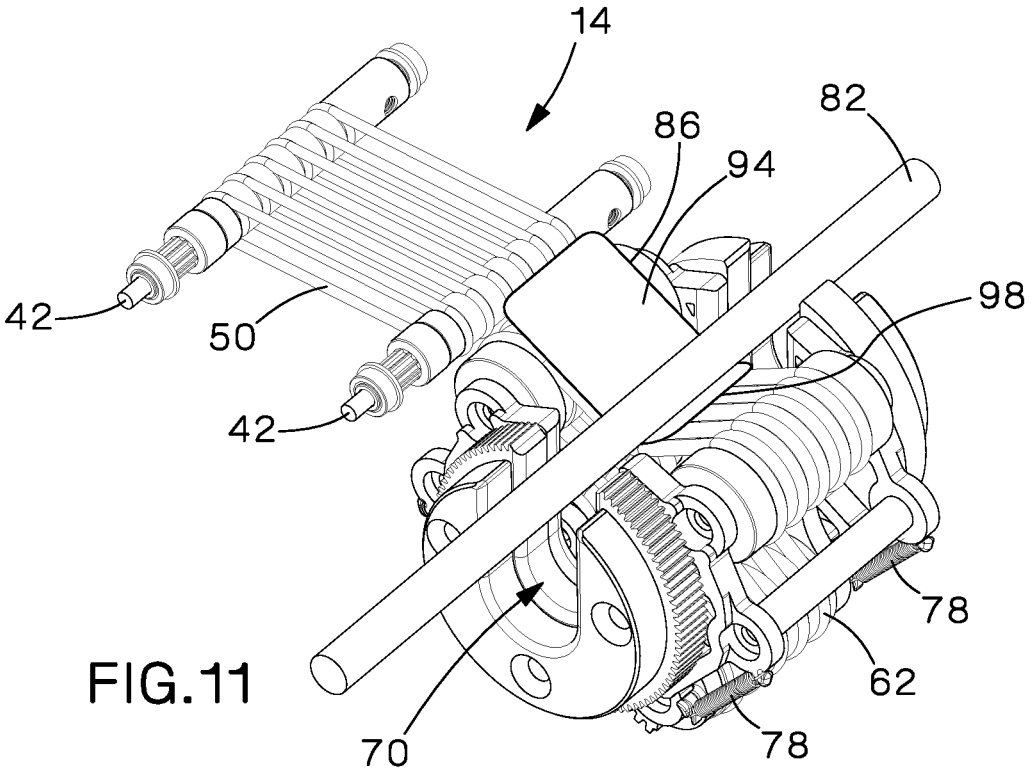
FIG. 11 is a third stage in a label applicator method.
Figure 12:
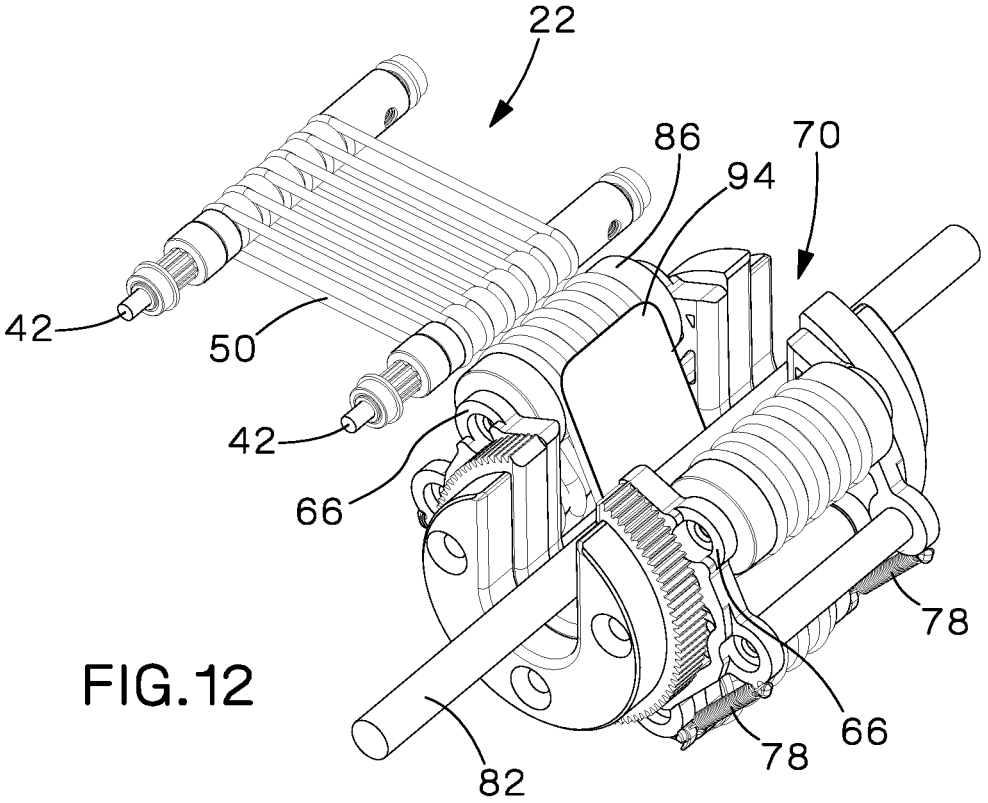
FIG. 12 is a fourth stage in a label applicator method.

Referring to FIGS. 9-12. printed labels 86 are presented to the label applicator 10 at an entry end of the incoming conveyor 14 with an adhesive side 94 of the label 86 facing away from the belt 50 surface (see FIG. 9). The label 86 is held in contact with the belt 50 surface by an air pressure provided by the suction system 22 that can pull air through gaps (or holes) in the belting 50. The incoming conveyor 14 is driven forward such that the label 86 is then transported along it to the wrapping mechanism 18.

The label 86, now positioned on the wrapping mechanism 18 (see FIG. 10), is held in place by the airflow provided by the suction system 22. When properly positioned, a leading edge 98 of the label 86 will extend past a center of the opening in the wrapping mechanism 18. Next, the object 82, e.g. a wire, cable or other elongated object, is inserted into the wrapping mechanism 18 so that the surface of the object 82 first contacts the label 86 adhesive and traps the label 86 between the object 82 and the surface of the belt 62 (see FIG. 11). As the object 82 is inserted further into the central portion 70 against the springs 78 force, the label 86 is pressed against the object 82 over an increasing arc length. Once the object 82 is inserted fully into the central portion 70 so that it is approximately at the center of the axis of rotation 79 of the wrapping mechanism 18, the wrapping mechanism 18 begins to rotate and the label 86 is pushed against the object 82 from all angles as the belt 62 moves along the surface of the object 82 (see FIG. 12). After rotating the wrapping mechanism 18 several times to ensure that the entire length of the label 86 has been pressed against the object 82, the object 82 may be removed from the wrapping mechanism 18. This rotation is accomplished simultaneously by the rollers 66 while the belt 62 remains freewheeling on the guide rollers 66.

Once removed, the process is complete and additional labels and objects may be processed in the same way.

Now referring to FIGS. 13-41, an embodiment of automated labeling apparatus 1010 for applying printed labels 1086 to objects 1082 such as wires, cables or other elongated elements is illustrated. The objects 1082 may have varying diameters. The labels 1086 are attached to the object by wrapping the label 1086 around the object 1082 without spinning, rotating, or twisting the object 1082 along/about its elongated longitudinal axis. This apparatus 1010 is useful for label types that require that the label 1086 to be wrapped around the object 1082 using more than one revolution. Self-laminating labels are one such type, requiring the transparent end of the label to be wrapped over top of the printed region to provide protection to the printed content.

Figure 13:
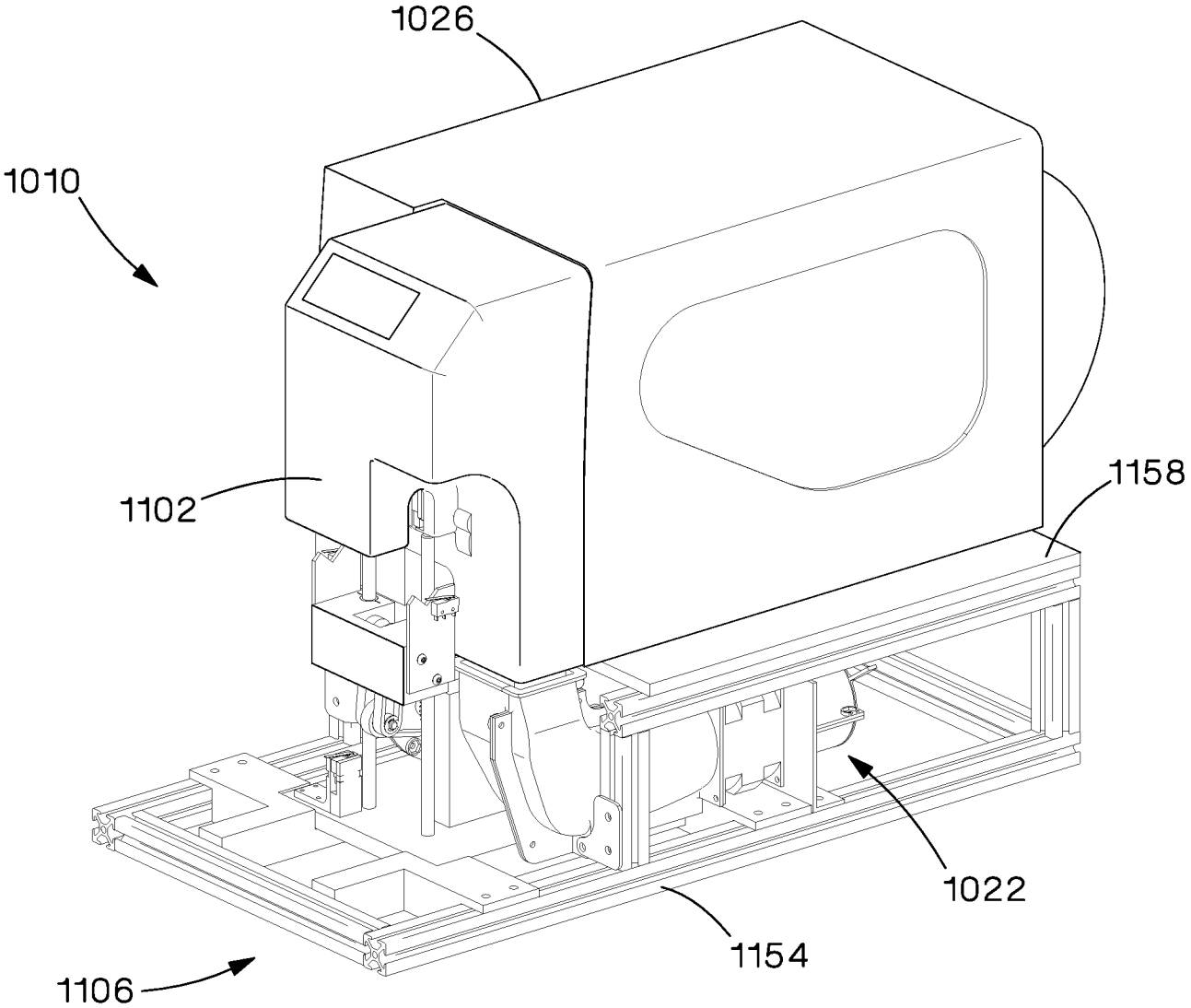
FIG. 13 is a perspective view of an apparatus of the present invention.

This automated label applicator 1010 comprises of two primary systems, as shown in FIG. 13, an applicator head 1102 and a support box 1106. The applicator head 1102 contains a label handler, an incoming conveyor 1014, and a wrapping mechanism 1018. The support box 1106 contains subsystems for cable insertion 1110, a suction system 1022 and an electrical system 1114. The support box 1106 also supports and positions a printer 1026. A printer 1026 and/or source of labels may be in operable alingment with the incoming conveyor 1014 to feed labels 1086 to the applicator 1010.

Figure 19:
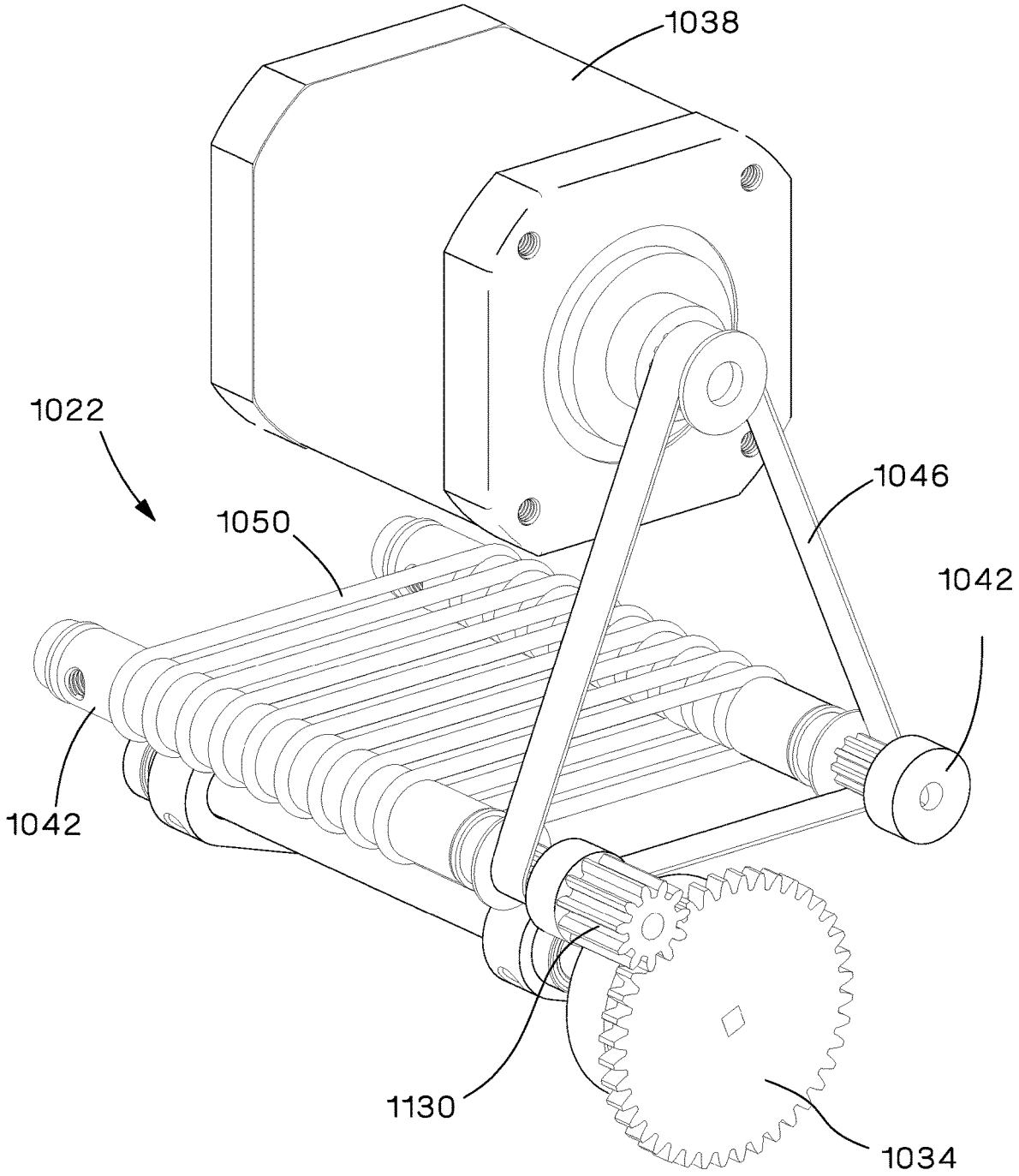
FIG. 19 is a perspective view of an incoming conveyor.

The incoming conveyor 1014 and the wrapping mechanism 1018 subsystems are shown, for example, in FIG. 19. These subsystems are positioned between a pair of support plates 1030. Each of these subsystems 1014,1018 is driven by a separate electric motor 1038,1054.

The incoming conveyor 1014 moves labels 1086 from a peel-and-present mechanism 1034 (shown in FIG. 23), integrated with the attached printer to the wrapping mechanism 1018. This subsystem 1014 includes a drive motor 1038 connected to two or more shafts 1042 using a drive belt 1046 and belts 1050 to rotate the shafts 1042 at the same rate. The shafts 1042 span an opening/space between the support plates 1030 and a series of round belts 1062 spaced with gaps between them (or one or more belts with holes through it) are held in tension around the shafts 1042.

Figure 20A:
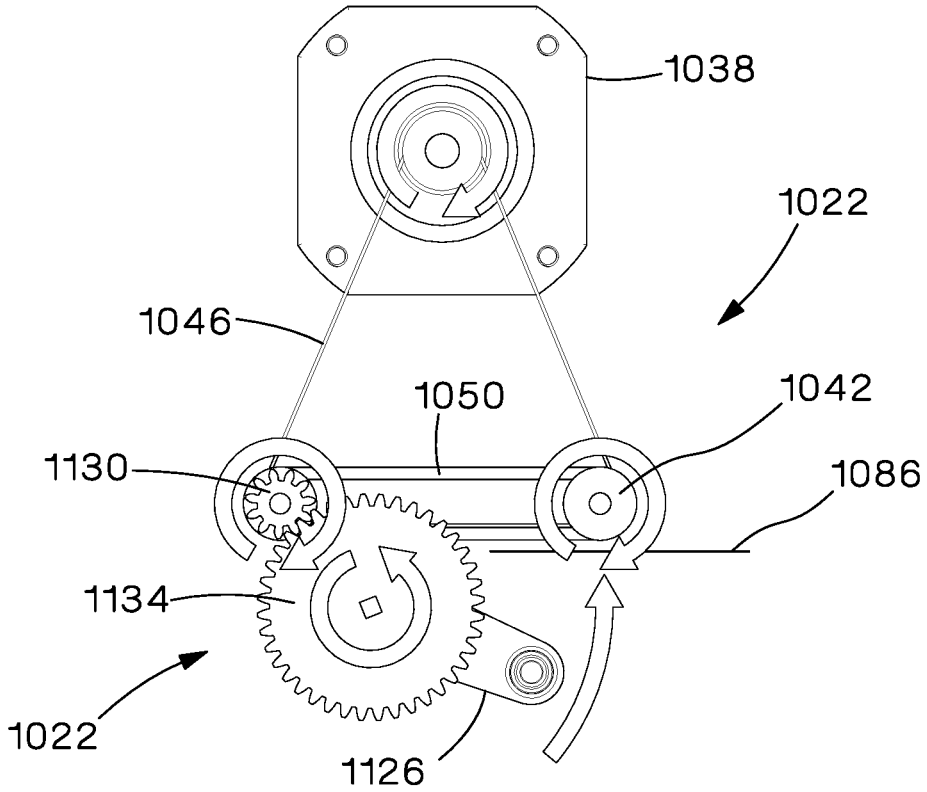
FIG. 20A is a side view of an incoming conveyor in use with a tensioner.

The incoming conveyor 1014 further includes a conveyor assist lever 1122 (see FIG. 20A). The conveyor assist lever 1122 acts as a nip roller to grip an incoming label 1086 and provide a tension needed to remove the label 1086 from the release liner, shown in FIG. 23. The conveyor assist lever 1122 is indirectly driven by the motor 1038 that drives the incoming conveyor 1014. A pinion 1130 is attached to the forward shaft 1042 of the incoming conveyor 1014 which drives a gear 1134 that is coupled to the conveyor assist lever 1122 using a viscous damper 1138 (see, e.g., FIGS. 24-27). The viscous damper 1138 transmits a torque to the conveyor assist lever 1122 based on a rotational speed of the gear 1134. As the gear's speed increases, the torque applied to the conveyor assist lever 1122 increases, as well. With sufficient speed, the conveyor assist lever 1122 raises until it reaches the label 1086 and pinches the label 1086 between a lever arm 1126 and the conveyor belt 1050. The resulting force increases a frictional force from the incoming conveyor belt 1050 and pulls the label 1086 forward towards the wrapping mechanism 1018. FIG. 20A shows the relative motion of the components when the conveyor assist lever 1122 is raised.

Figure 20B:
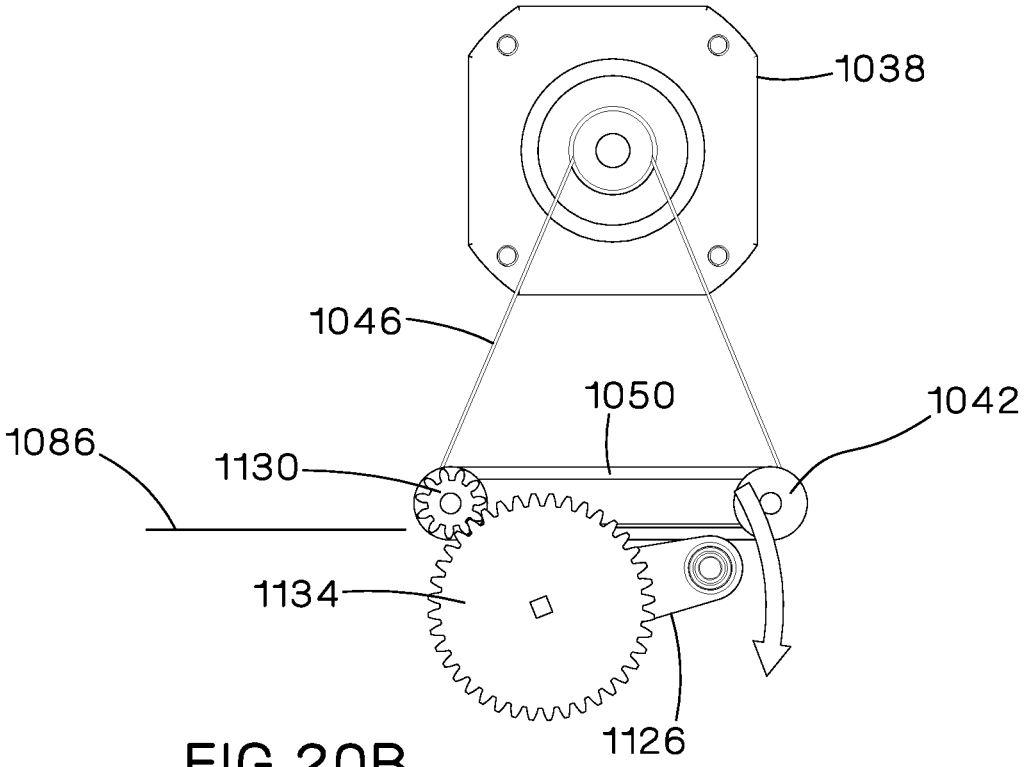
FIG. 20B is a side view of an incoming conveyor in use with a tensioner.

When the incoming conveyor 1014 stops or slows sufficiently, the torque applied to the conveyor assist lever 1122 is reduced, and conveyor assist lever 1122 drops to the original position in preparation for a new label 1086, as shown in FIG. 20B.

Figure 21:
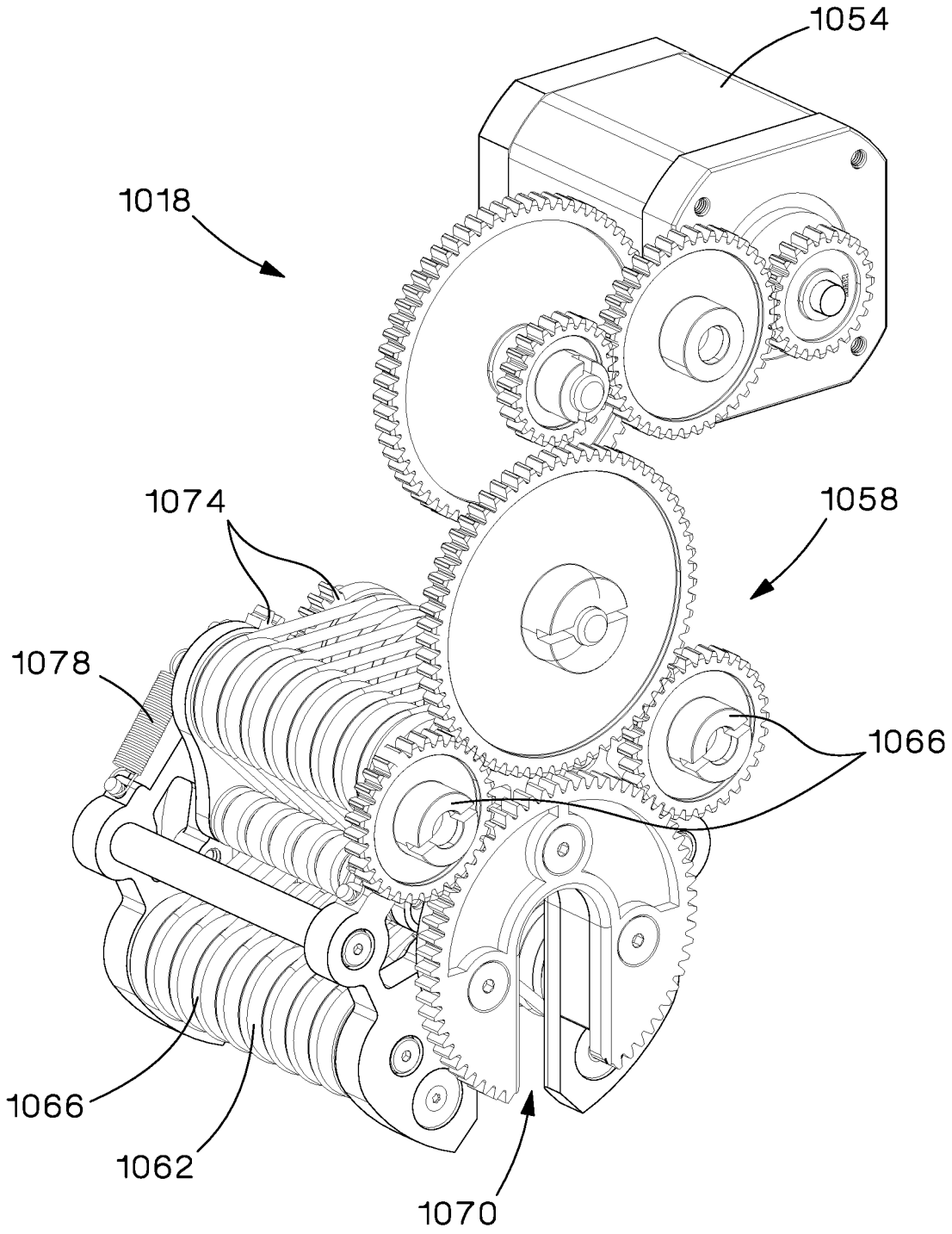
FIG. 21 is a perspective view of a wrapping mechanism.
Figure 22:
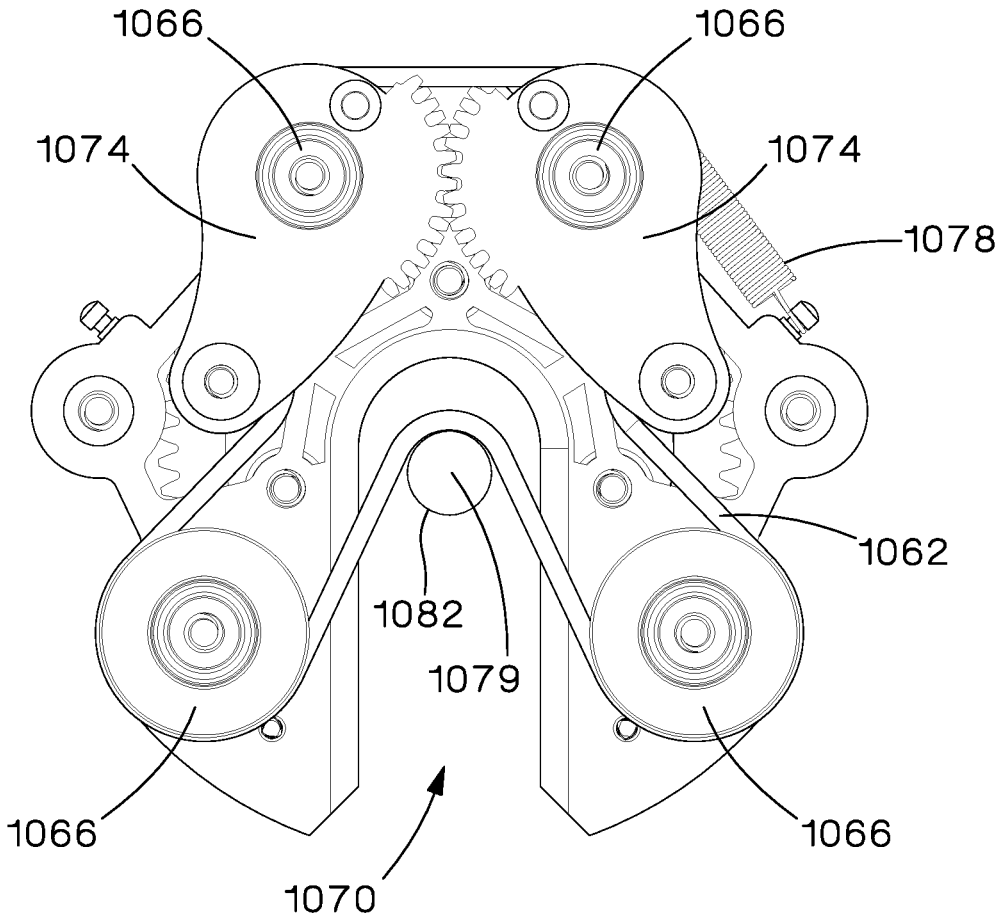
FIG. 22 is a side view of a wrapping mechanism.

The wrapping mechanism 1018 is shown in FIG. 21. The wrapping device 1018 is a rotating device driven by a motor 1054 and gear train 1058 (alternatively a belt, chain, or the like) and is further detailed in FIG. 22. The wrapping mechanism 1018 has a belt system 1062 of similar construction to the incoming conveyor 1014 within it. The wrapping mechanism 1018 has a plurality of guide rollers 1066, preferably four, that provide the primary guidance for the wrapping mechanism belts 1062. These guide rollers 1066 are spaced around/about a perimeter of the wrapping mechanism 1018, so that a central portion 1070 of the wrapping mechanism 1018 is free from guide rollers 1066.

The wrapping mechanism has tensioner arms 1074 that are held in tension with extension springs 1078. The tensioner arms 1074 remove slack in the belts 1062 and keep the belts 1062 straight and taught. This allows the belts 1062 to be pushed into the wrapping mechanism's central portion 1070 toward an axis of rotation 1079 (FIG. 22) of the wrapping mechanism 1018 by the object 1082, such as a wire, cable or other cylindrical object. When the object 1082 is inserted into the wrapping mechanism 1018 until it reaches approximately a center of the wrapping mechanism's rotational axis 1079, i.e. when the object 1082 is aligned with the axis of rotation 1079 such that the axis of rotation is located with a cross-sectional area of the object 1082, the wrapping mechanism 1018 rotates or obits about its rotational axis 1079 one or more times, so that a surface of the belt 1062 travels along a full circumference of the object 1082. Again, this rotation is accomplished simultaneously by the rollers 1066 while the belt 1062 remains freewheeling on the guide rollers 1066. The belts 1062 push against the object 1082 with a tension provided by the tensioner arms 1074. While the wrapping mechanism 1018 is rotated (i.e. orbiting the object 1082), the belts 1062 are driven by a contact between the belt 1062 surface and the object 1082 that is within the central portion 1070 of the wrapping mechanism 1018.

Figure 23:
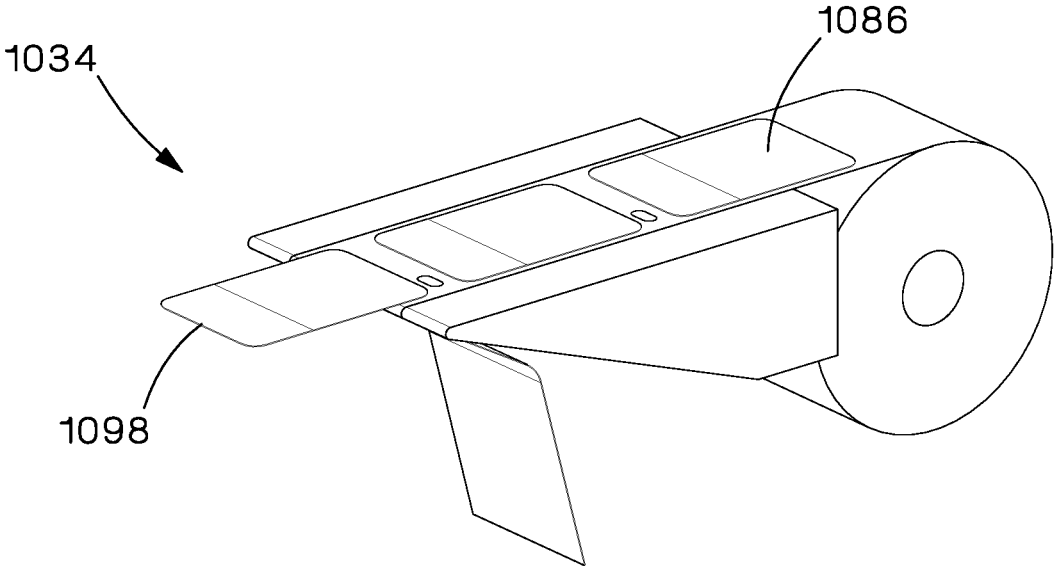
FIG. 23 is a perspective view of a label peel-and-present mechanism.
Figure 24:
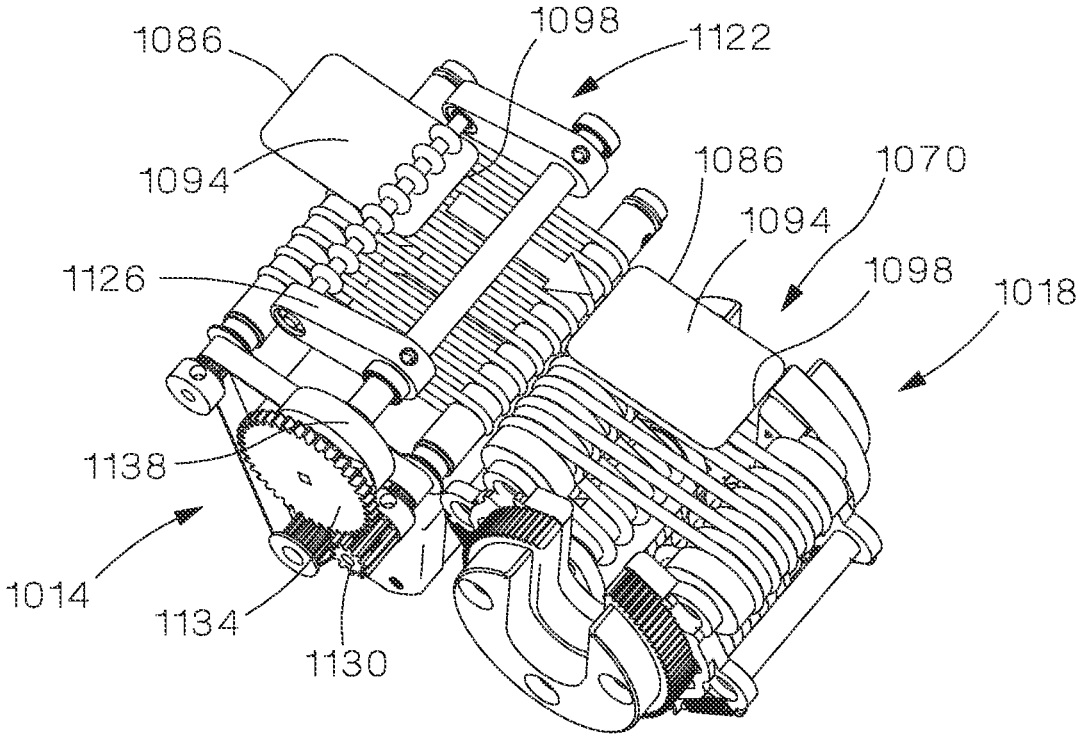
FIG. 24 is a first stage in a label applicator method.
Figure 25:
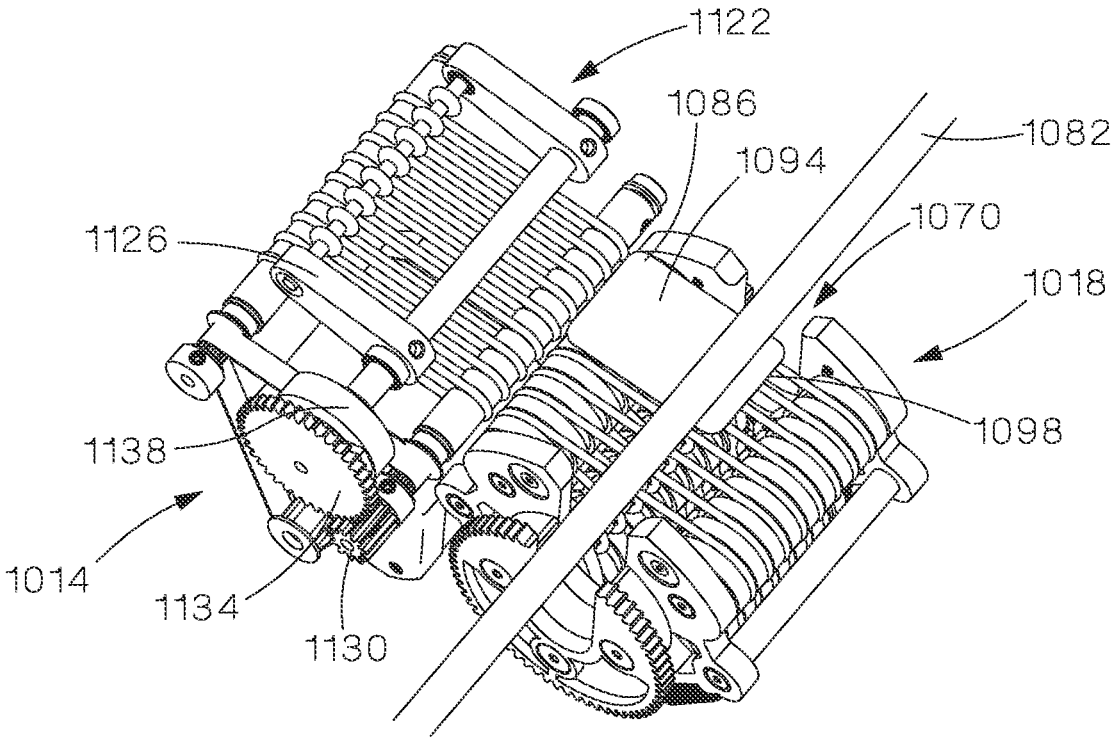
FIG. 25 is a second stage in a label applicator method.
Figure 26:
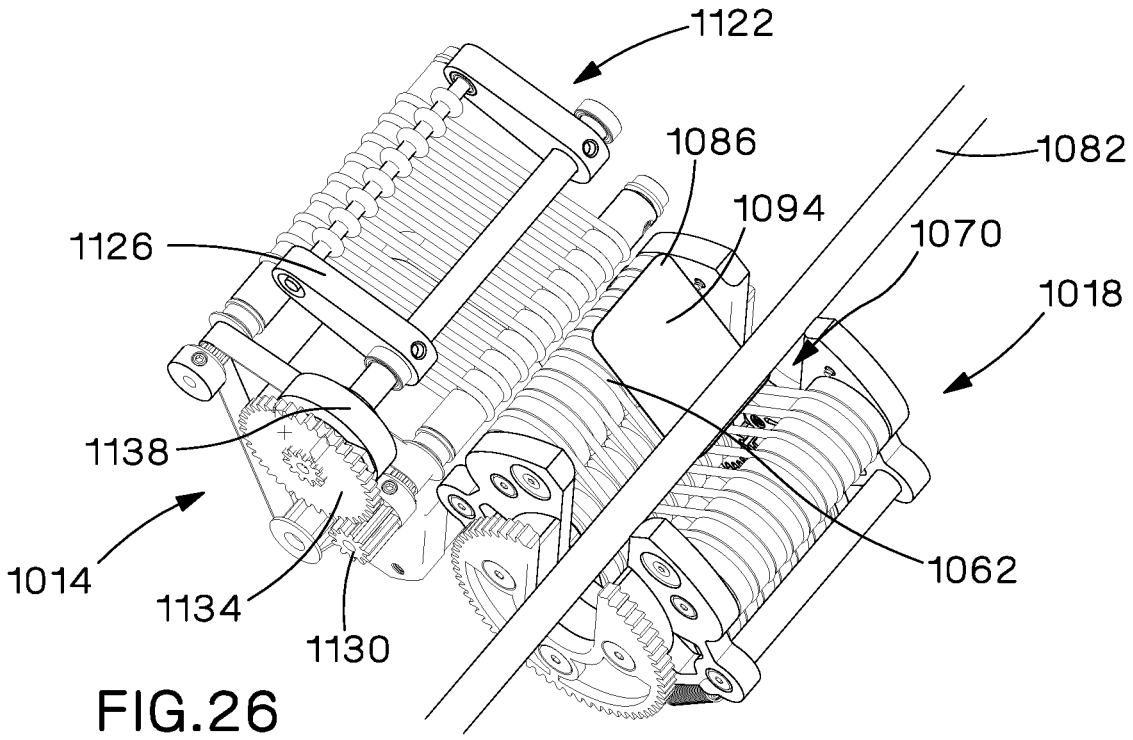
FIG. 26 is a third stage in a label applicator method.
Figure 27:
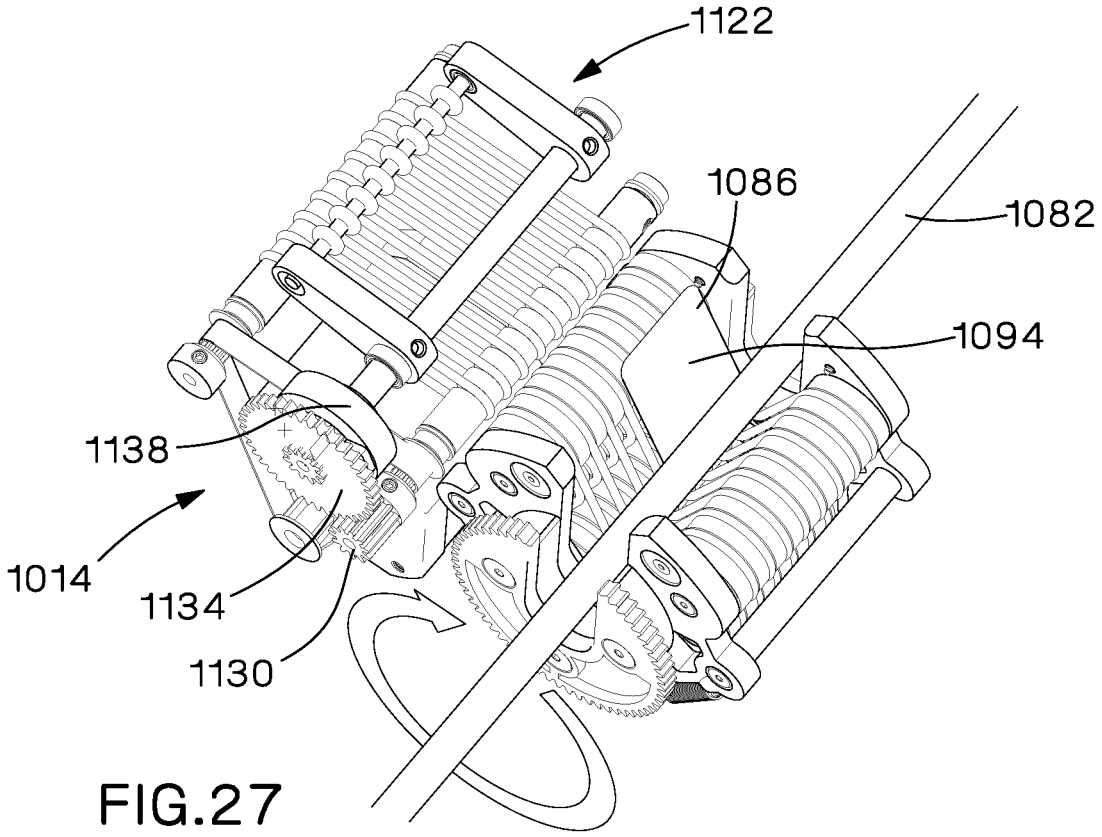
FIG. 27 is a fourth stage in a label applicator method.
Figure 28:
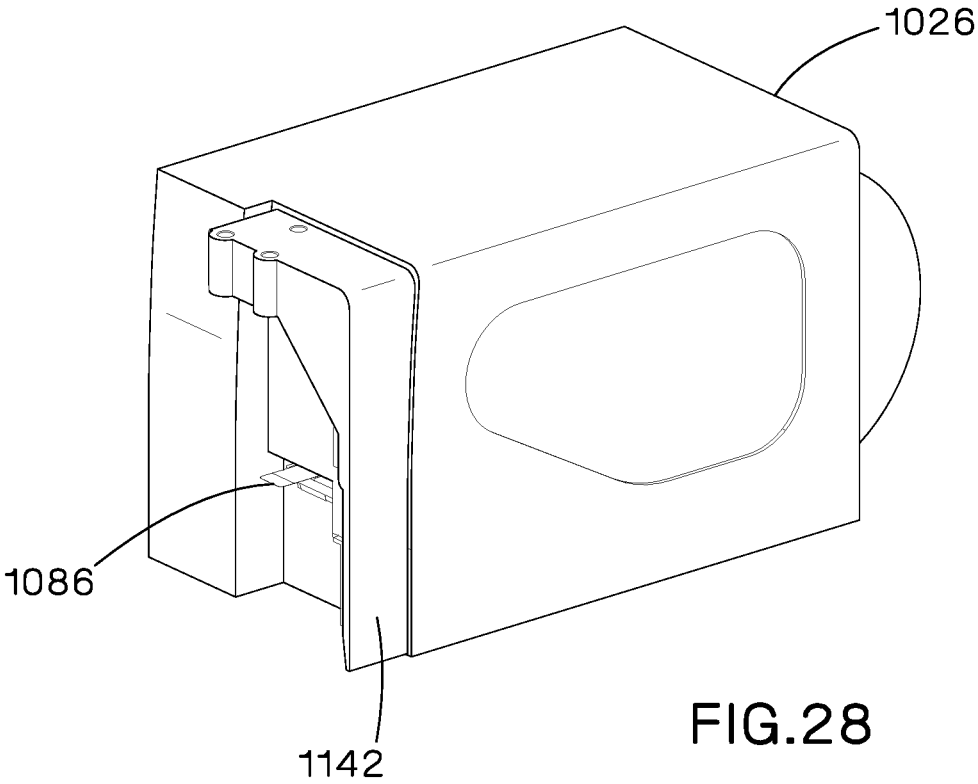
FIG. 28 is a perspective view of a printer.

The incoming conveyor 1014, wrapping mechanism 1018, and suction system 1022 work together to control and transport labels 1086 presented to the label applicator 1010 from a label peel-and-present mechanism 1034 that is independent of the label applicator 1010. A typical peel-and-present mechanism 1034 is depicted in FIG. 23; however, the mechanism 1034 could be a stand-alone device with pre-printed media or attached to the output of a desktop label printer 1026, as shown in FIGS. 13 and 28.

The printer 1026 presents printed labels 1086 the label applicator 1010 at an entry end of the incoming conveyor 1014 with an adhesive side 1094 of the label 1086 facing away from the belt 1050 surface (see, e.g. FIGS. 24-27). The label 1086 is held in contact with the belt 1062 surface by an air pressure provided by the suction system 1022 that can pull air through gaps (or holes) in the belting 1050. The incoming conveyor 1014 is driven forward such that the label 1086 is then transported along it to the wrapping mechanism 1018.

The label 1086 is positioned on the wrapping mechanism 1018 (see FIGS. 24 and 25) and held in place by the airflow provided by the suction system 1022. When properly positioned, a leading edge 1098 of the label 1086 will extend past a center of the central portion 1070 in the wrapping mechanism 1018. Next, the elongated object 1082 is inserted into the central portion 1070 of the wrapping mechanism 1018 so that the surface of the object 1082 first contacts an adhesive on the adhesive side 1094 of the label 1086 and traps the label 1086 between the object 1082 and the surface of the belt 1062 (see FIG. 26). As the object 1082 is inserted further into the central portion 1070, the label 1086 is pressed against the object 1082 over an increasing arc length. Once the object 1082 is inserted fully into the central portion 1070, so that the axis of rotation 1079 of the wrapping mechanism 1018 is position within the cross-sectional area of the object 1082, preferably with the axis of rotation 1079 coincident with a center longitudinal axis of the object 1082, as determined by switches or sensory means, the wrapping mechanism 1018 rotates as driven by the gear train 1058 such that it orbits about the object 1082, and the label 1086 is pushed against the object 1082 from all angles as the belt 1062 moves along the surface of the object 1082 (see FIG. 27). After rotating about its axis of rotation 1079, or orbiting about the object 1082, several times to ensure that the entire length of the label 1086 has been pressed against the object 1082, the object 1082 may be removed from the central portion 1070 of the wrapping mechanism 1018.

Once removed, the process is complete and additional labels and objects may be processed in the same way.

An industrial label printer 1026 can be purchased or retrofitted with optional peel and present modules. A typical system is depicted in FIG. 28. Such a printer 1026 can be used to deliver a printed label 1086 to the incoming conveyor 1014 by adapting a support duct 1142 shown in FIGS. 17 and 28 to attach to the printer 1026. FIG. 28 shows the support duct 1142 installed on the printer 1026. The support duct 1142 attaches the incoming conveyor 1014, the wrapping mechanism 1018 and a cover duct 1146, which protects the incoming conveyor 1014 and the wrapping mechanism 1018, to the printer 1026 (see FIGS. 17 and 28).

Figure 14:
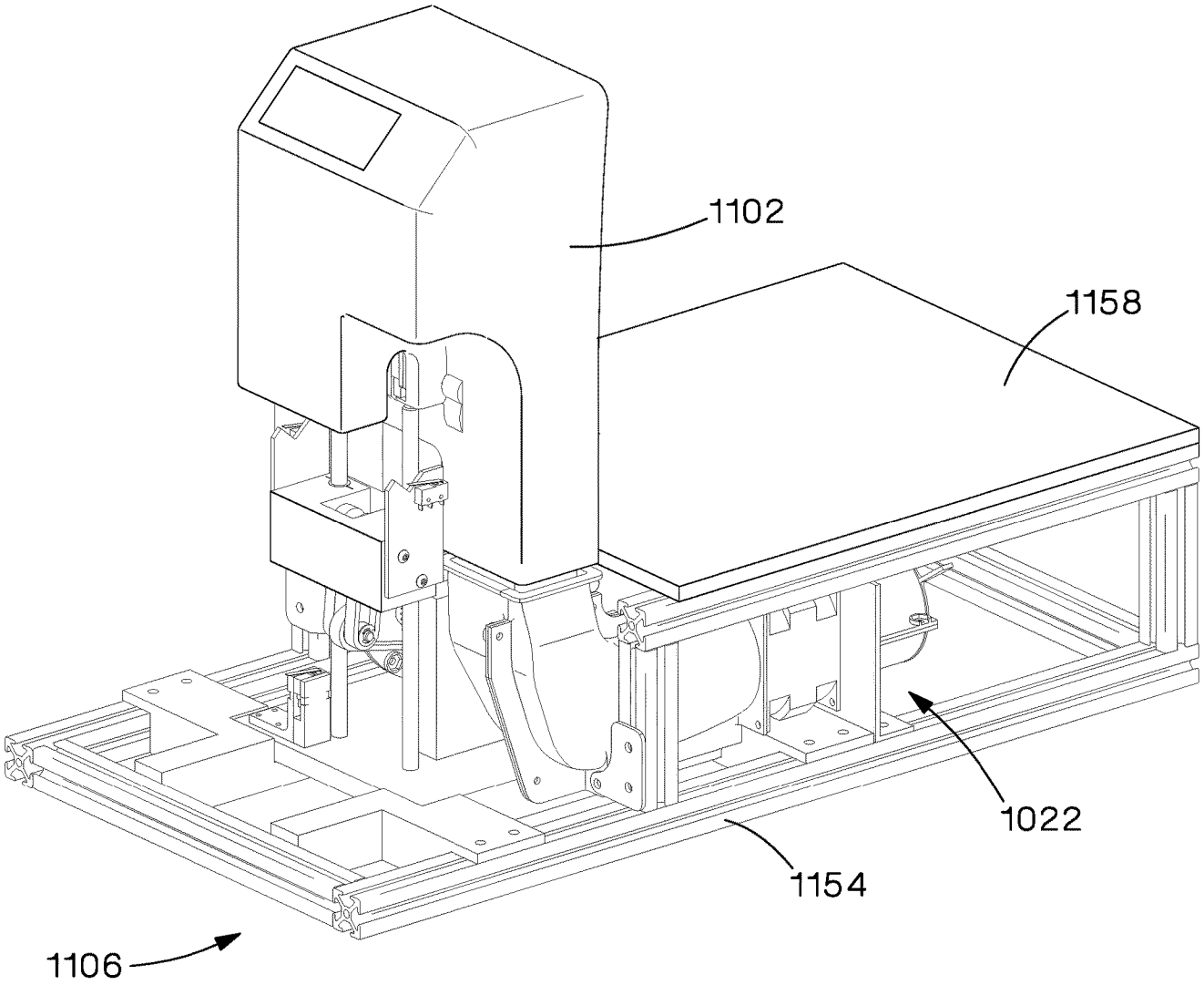
FIG. 14 is a perspective view of an apparatus of the present invention with a printer removed.
Figure 15:
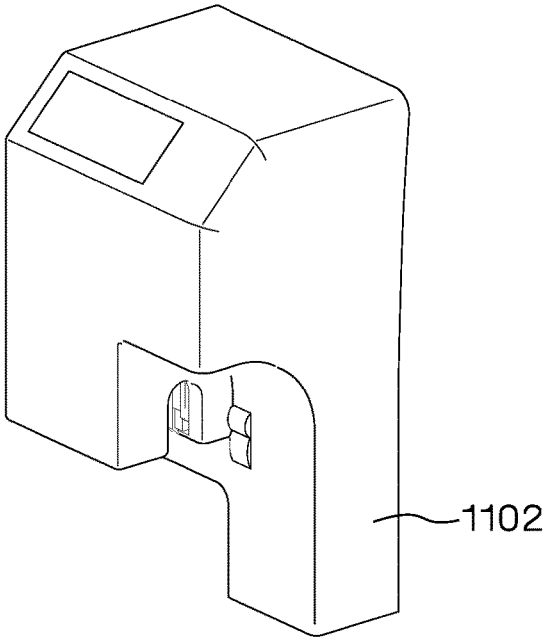
FIG. 15 is a perspective view of an applicator head.
Figure 16:
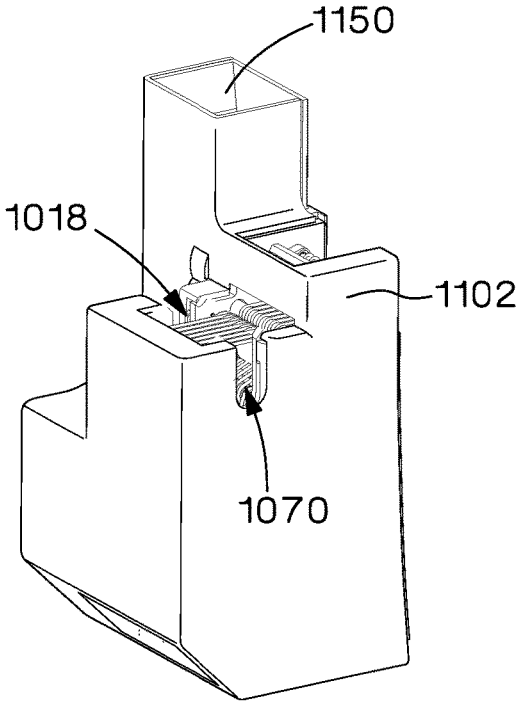
FIG. 16 is a perspective view from the bottom of an applicator head.
Figure 17:
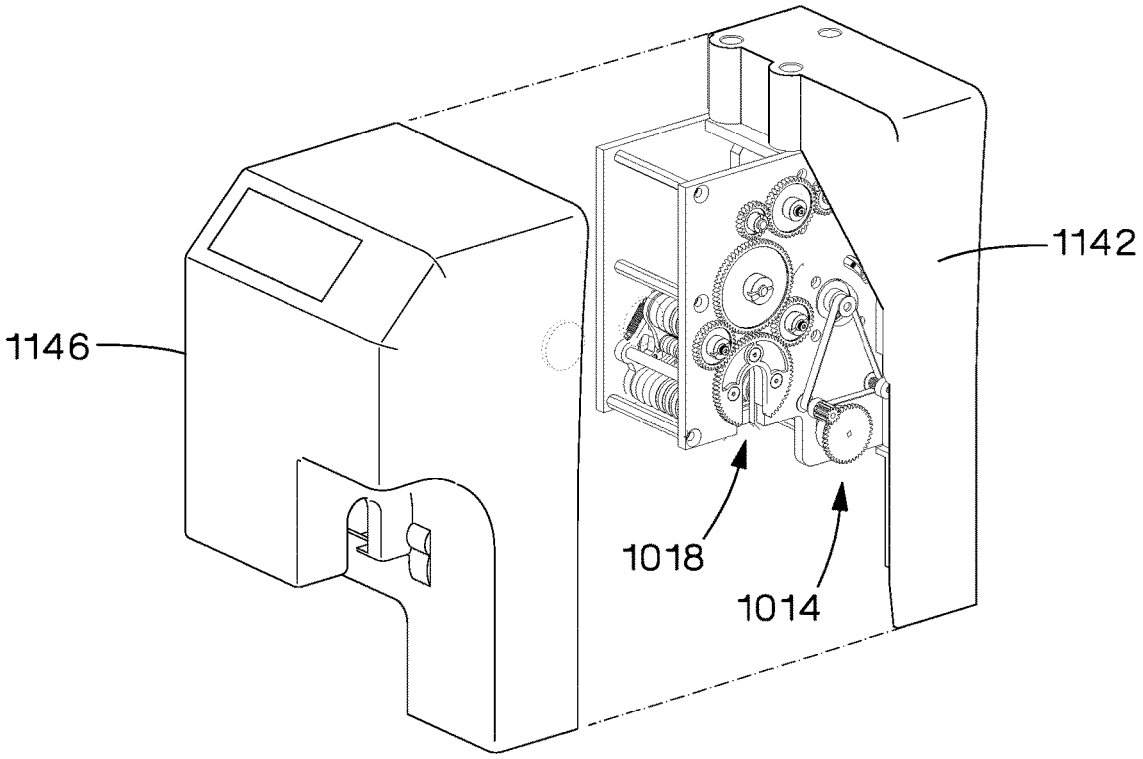
FIG. 17 is a semi-exploded view of an applicator head.
Figure 18:
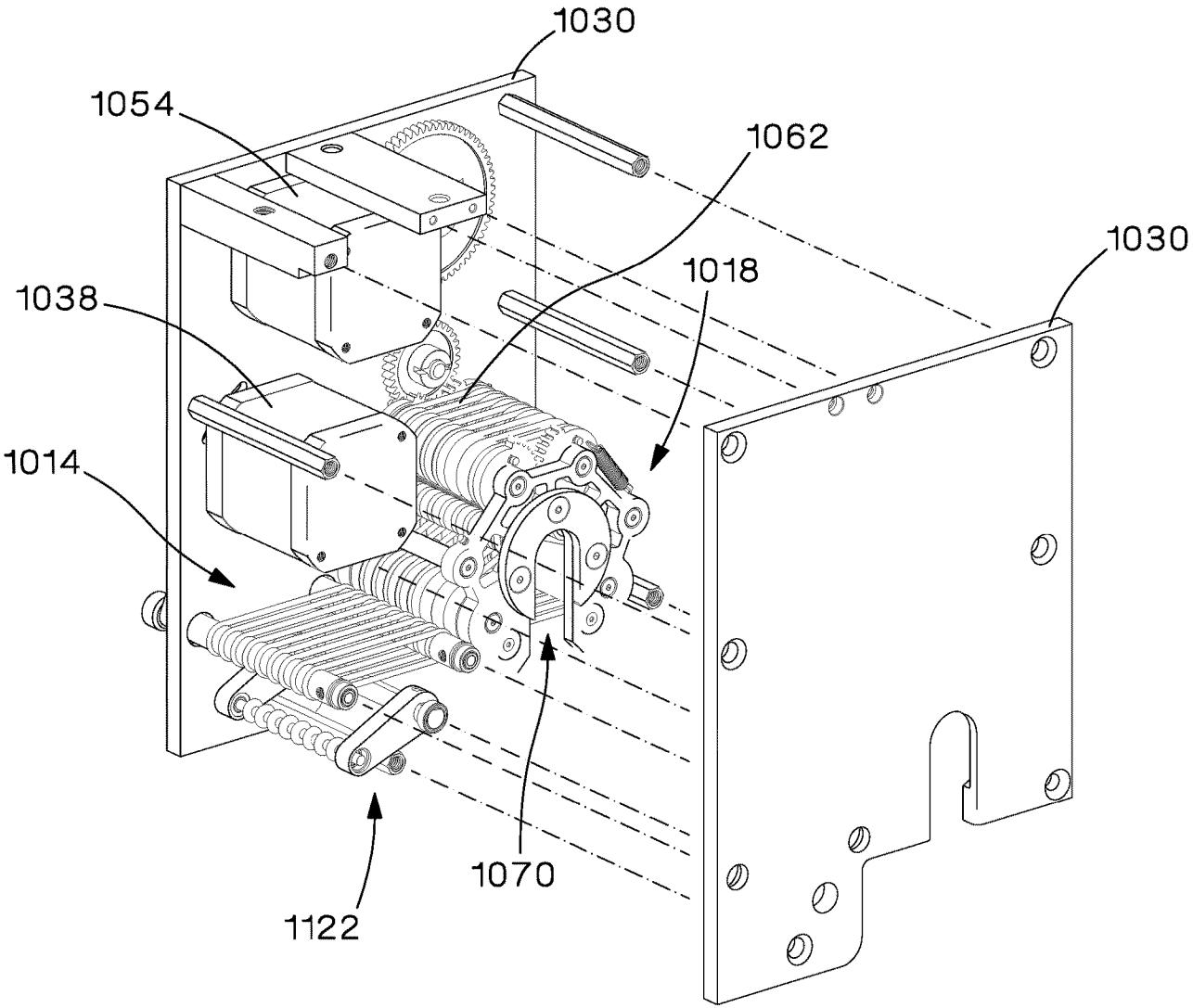
FIG. 18 is a semi-exploded view of a portion of an applicator head.
Figure 29:
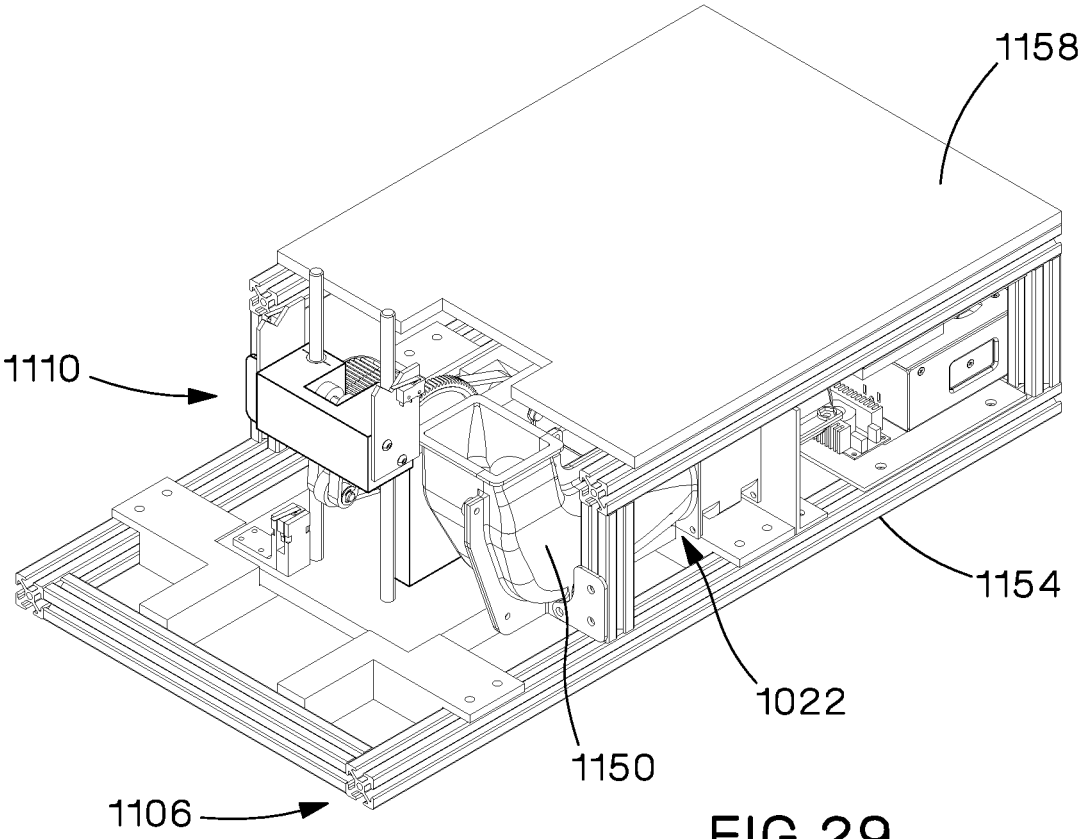
FIG. 29 is a perspective view of a support box.
Figure 30:
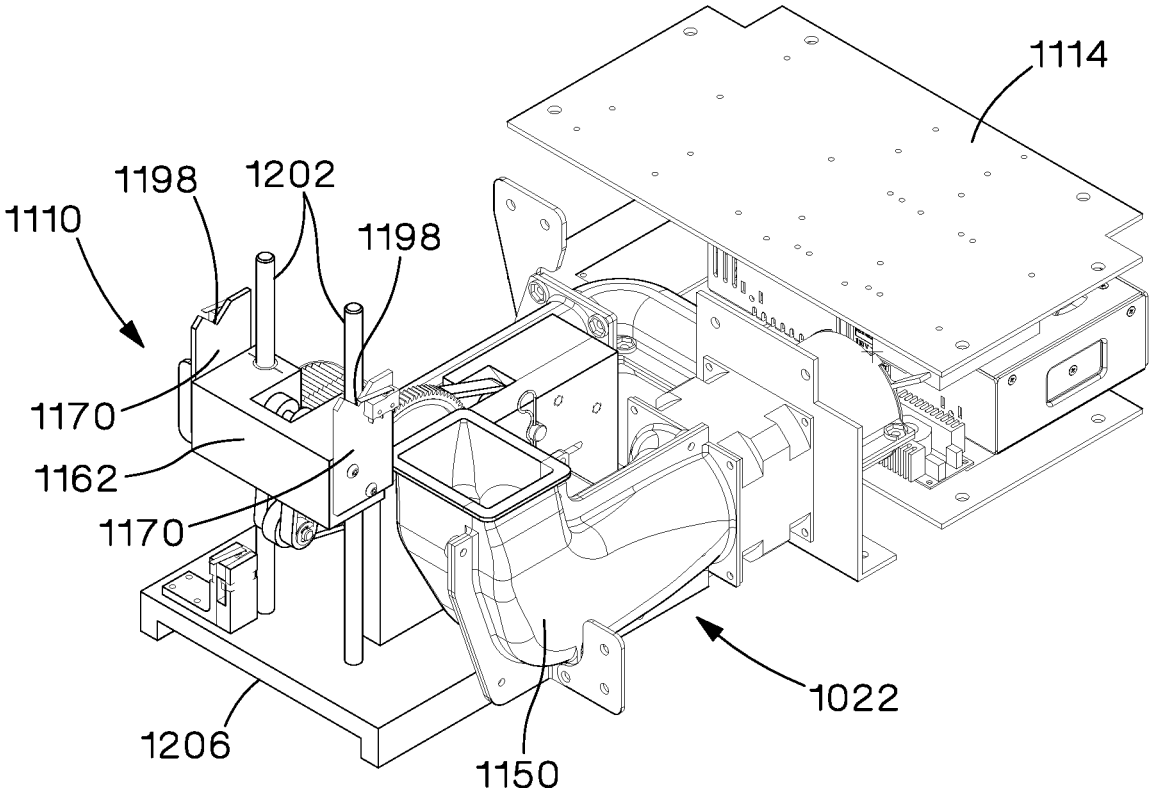
FIG. 30 is a perspective view of a support box with the platform removed.
Figure 31:
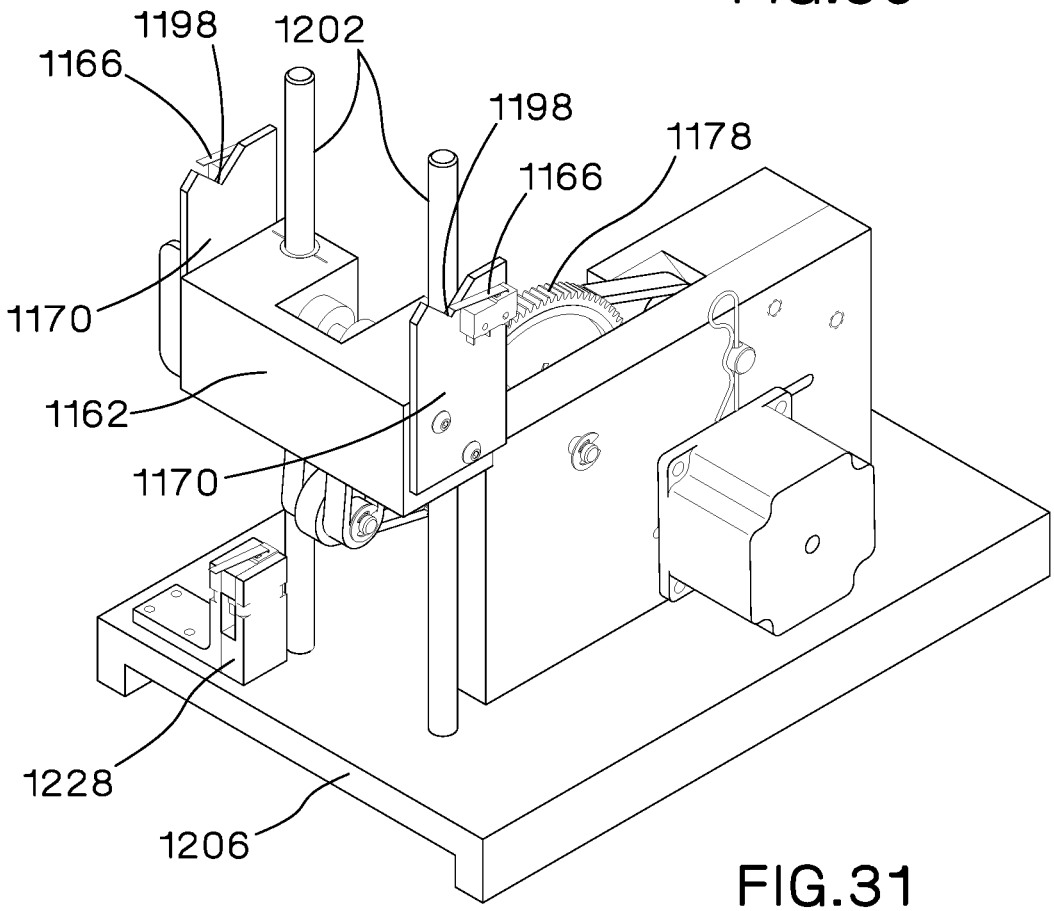
FIG. 31 is a perspective view of an object lift mechanism.

The support box 1106 shown in FIGS. 13 and 14 is isolated in FIG. 29. The support box 1106 houses or supports the cable insertion system 1110, a label vacuum duct 1150, and electronics 1114 for driving the applicator head 1102, cable insertion system 1110, and suction system 1022. The support box 1106 comprises an aluminum frame 1154 and a platform 1158 on which the printer 1026 is supported. FIG. 30 shows the support box 1106 with the platform 1158 removed to reveal the electronics 1114 in the form of a circuit board.

The cable insertion system 1110 is an electromechanical assembly that shuttles and holds the object 1082 in position in the wrapping mechanism 1018. After the label 1086 is wrapped about the object 1082, the cable insertion system 1110 removes the object 1082 from the wrapping mechanism 1018. The cable insertion system 1110 includes a lift 1162 which delivers a section of the object 1082 into the central portion 1070 of the wrapping mechanism 1018.

The cable insertion system 1110 starts the wrapping process via a switch 1166, preferably a snap-action process switch, preferably two such switches, mounted on a cradle 1170 upon which the object 1082 is raised and lowered. The process begins when both switches 1166 are actuated, preferably simultaneously activated.

Figure 32:
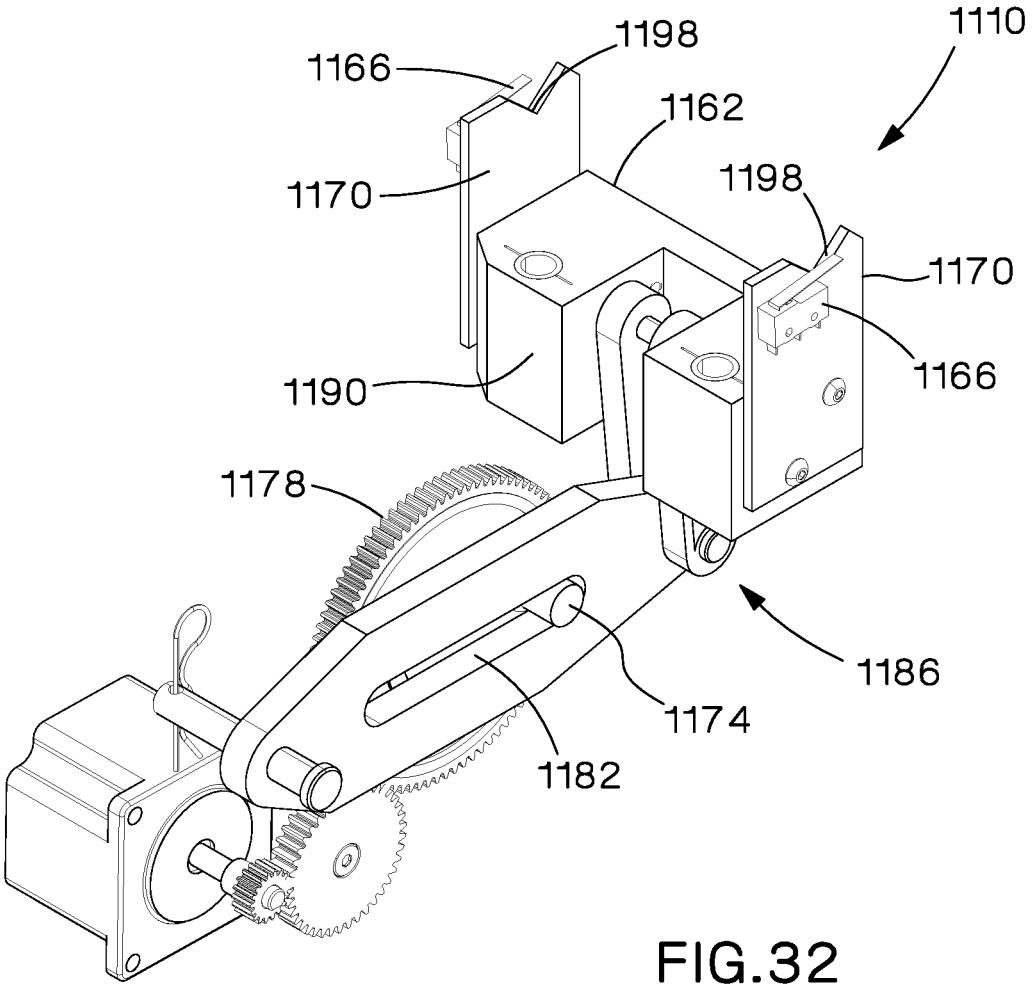
FIG. 32 is a perspective view of a portion of the lift mechanism.
Figure 33:
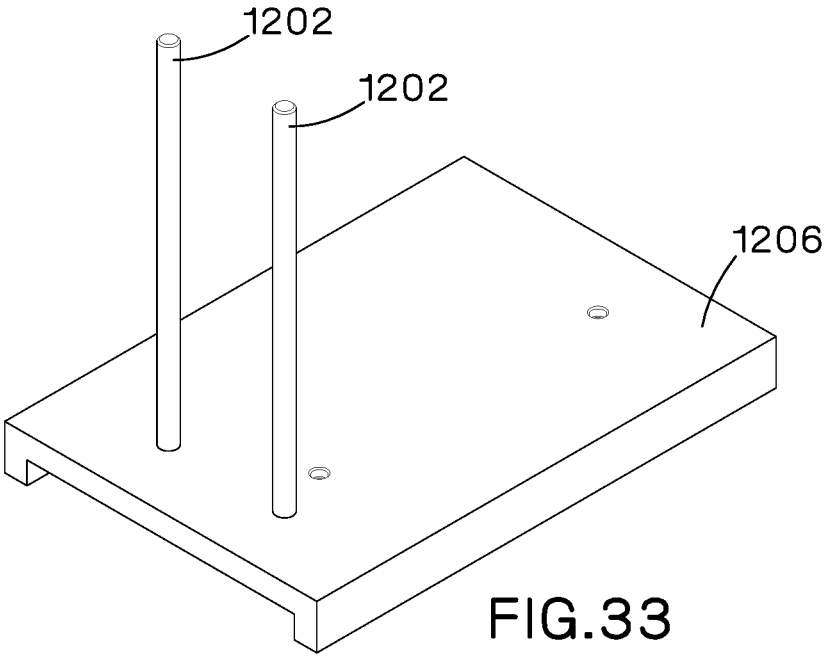
FIG. 33 is a perspective view of a portion of the lift mechanism.
Figure 34:
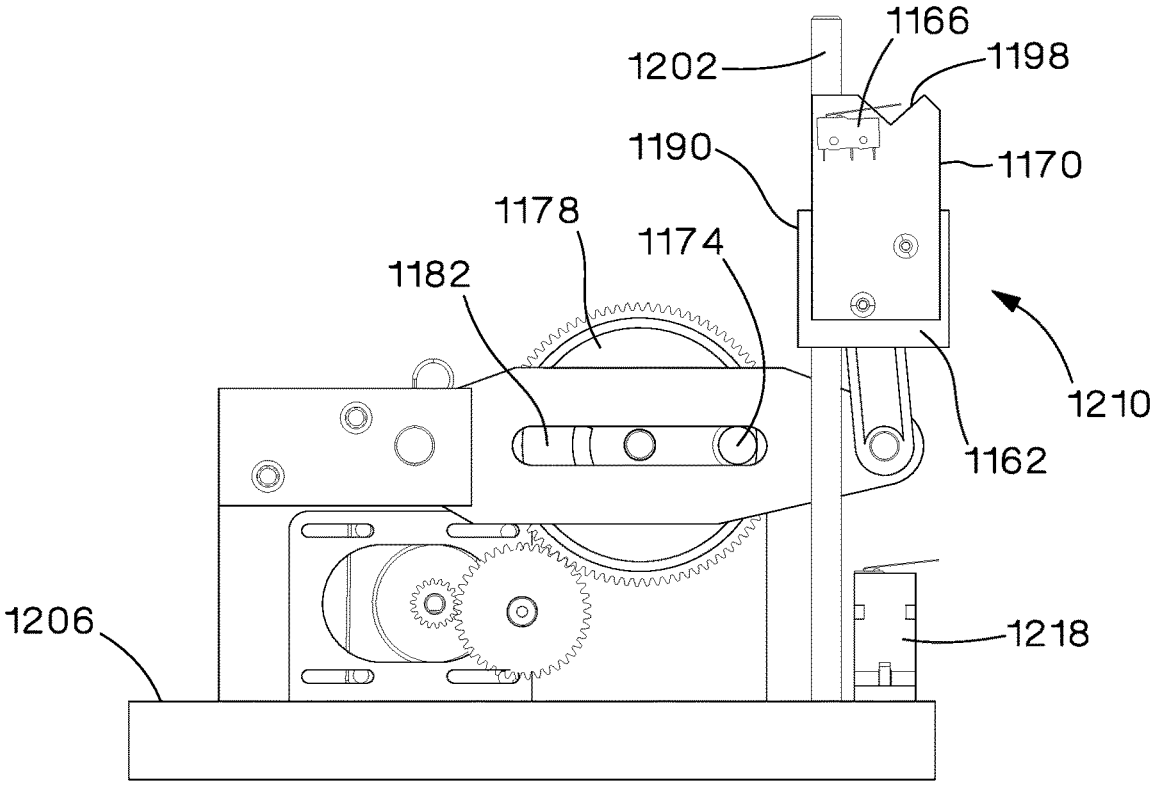
FIG. 34 is a side view of a portion of the lift mechanism in a home position.
Figure 36:
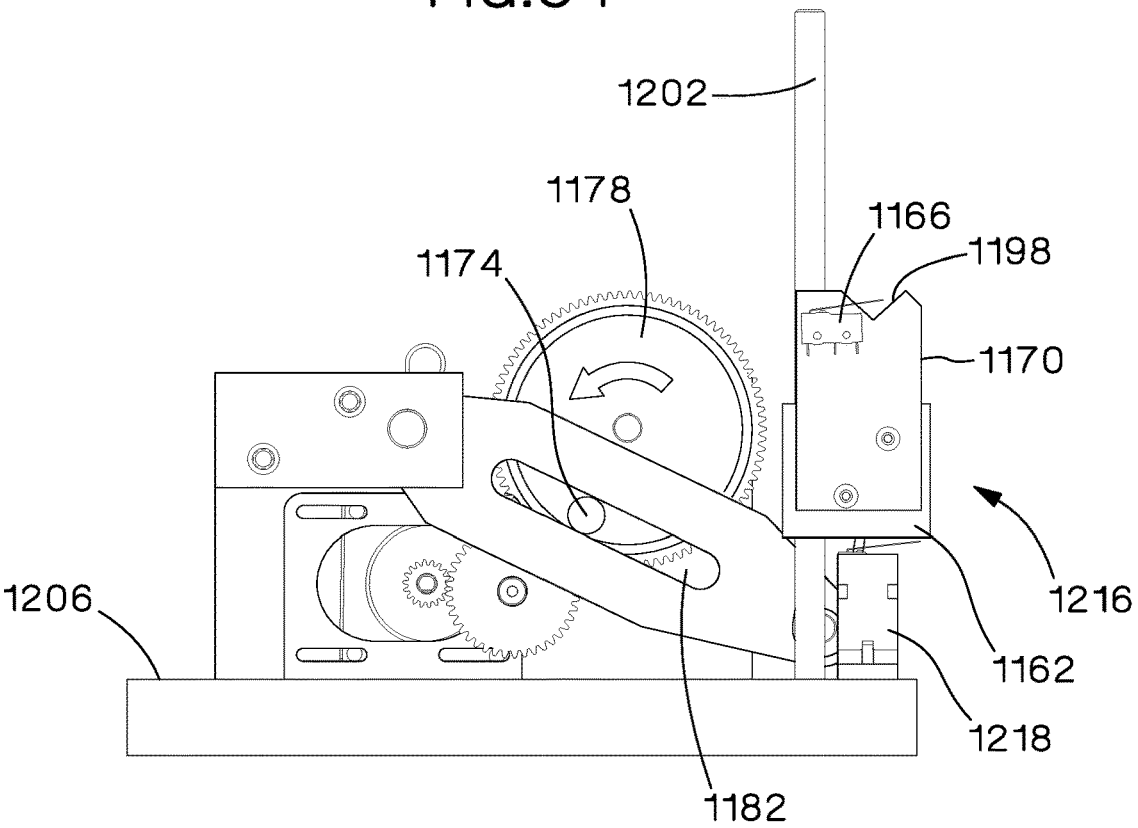
FIG. 36 is a side view of a portion of the lift mechanism in an eject position.
Figure 35:
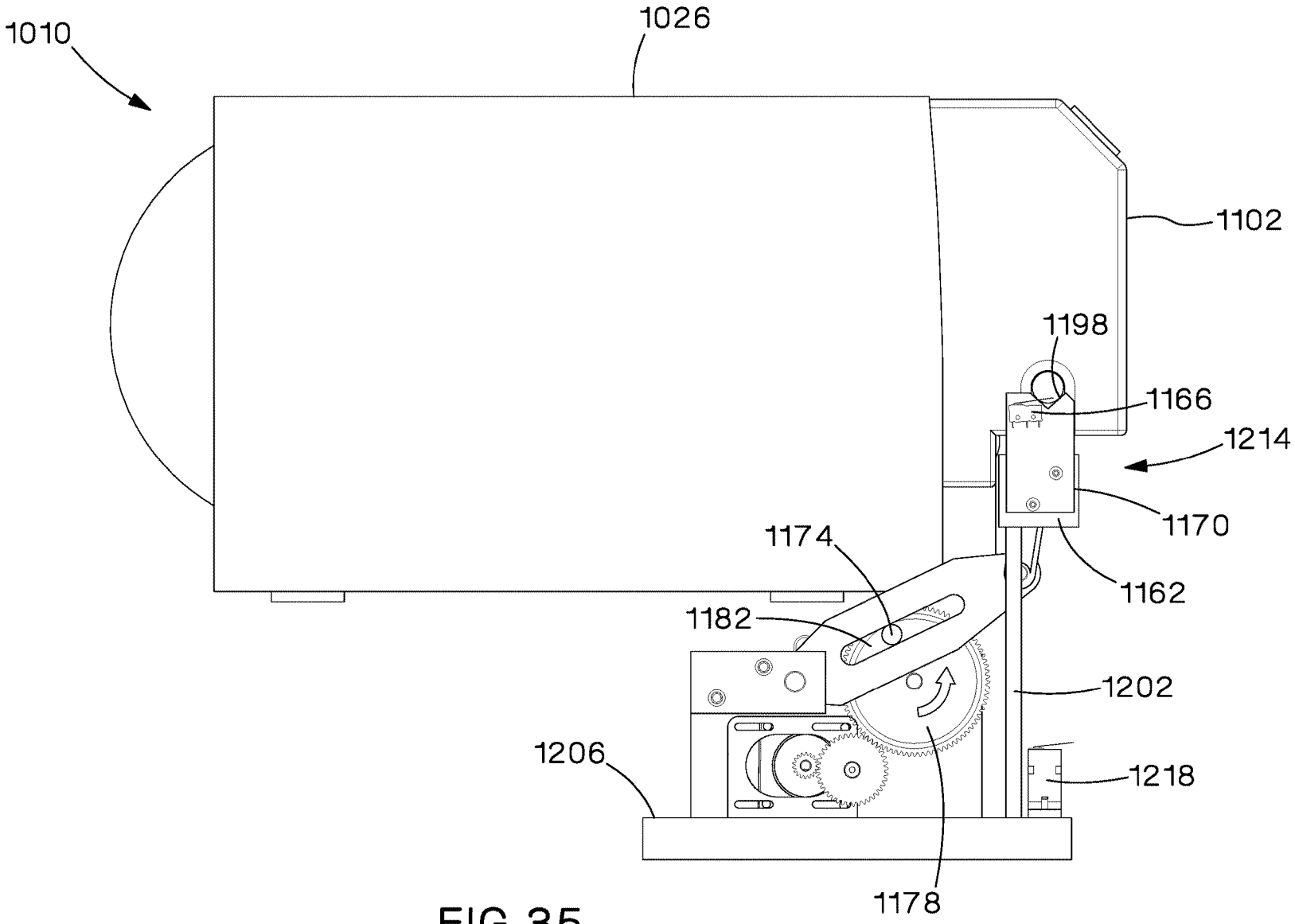
FIG. 35 is a side view of a portion of the lift mechanism in a wrap position.
Figure 37:
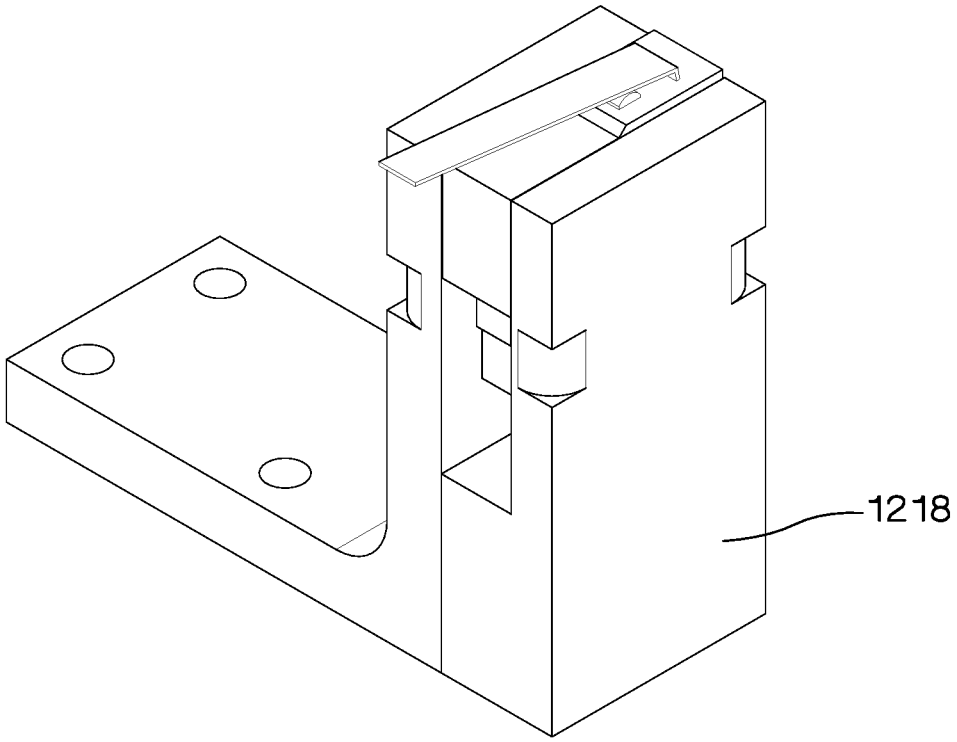
FIG. 37 is a perspective view of an eject switch.

As illustrated in FIG. 32, the cradle 1170 is movable, preferably vertically, by a lift 1162. In the embodiment illustrated the lift 1162 is a scotch yoke-style mechanism. A pin 1174 is integrated into a spur gear 1178 interfacing a slot 1182 in a main link 1186. A range of motion of a shuttle 1190 is determined by a length of linkages and a stroke of the pin 1174.

The cradle 1170 is a rigid feature with a recess 1198, preferably V-shaped, to center the object 1082. The recess 1198 may be spring-loaded to allow variations in the size of the object 1082 to be wrapped. A path of the shuttle 1190 is defined by a guide, preferably two steel guide rods 1202 mounted to a base 1206.

When the label applicator 1010 is initialized, the lift 1162 is moved to a home position 1210 with the shuttle 1190 at mid-stroke if it is not already there. Here, it will stay until the switches 1166 are actuated, as described above.

When the switches 1166 are actuated, the lift 1162 moves to a wrap position 1214, shuttling the object 1082 into the applicator head 1102, preferably into the central portion 1070 of the wrapping mechanism 1018. It stays in this position while the applicator head 1102 completes a wrap cycle as described above.

When the wrap is completed, the cable insertions system 1110 advances further, retracting the shuttle 1190 to a bottom of the stroke where it contacts an eject position switch 1218, signaling to the label applicator 1010 that the cycle is complete. The shuttle 1190 is then returned to the home position 1210 to await the next object 1080.

Figure 38:
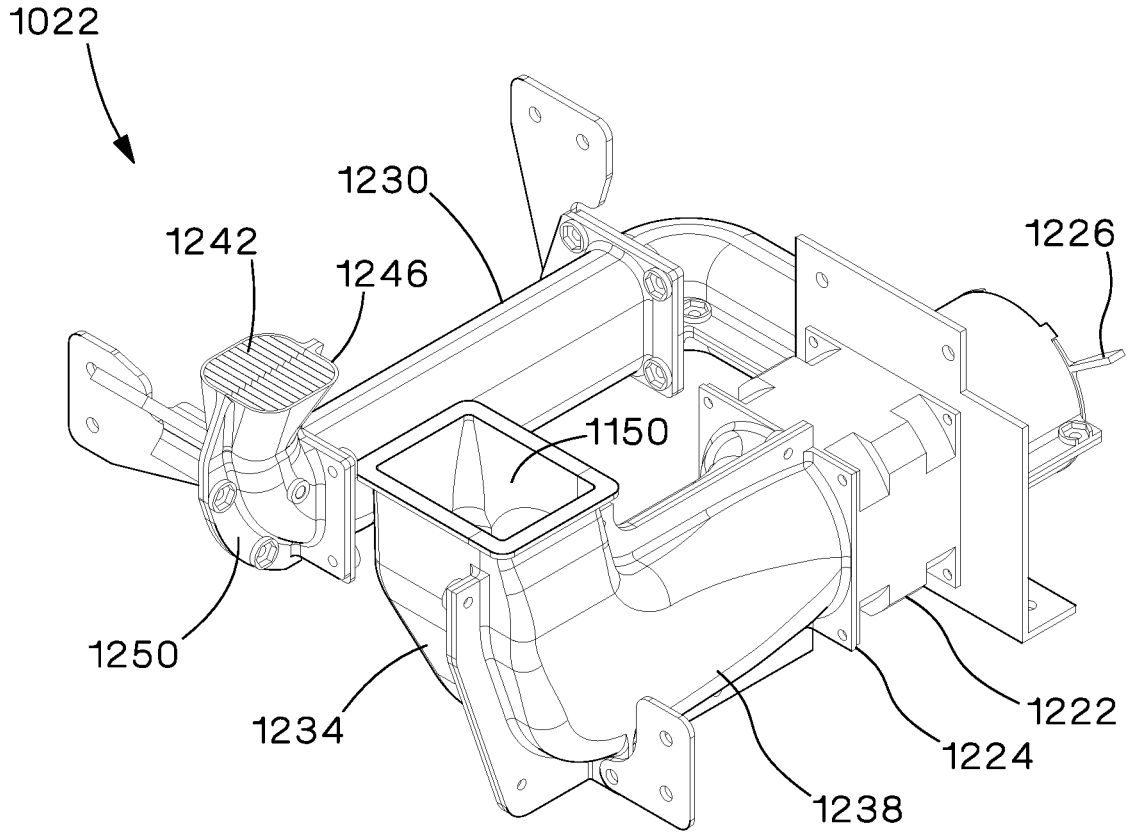
FIG. 38 is a perspective view of a suction system.
Figure 39:
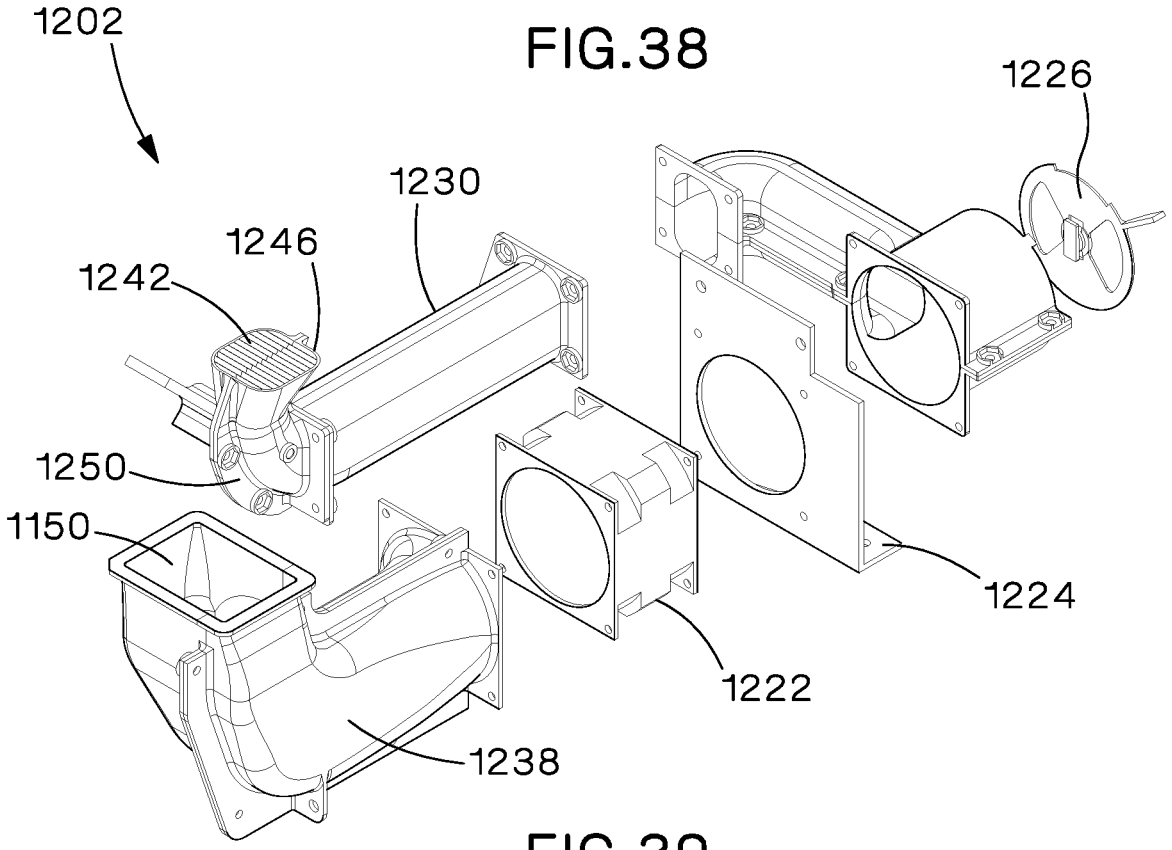
FIG. 39 is an exploded view of a suction system.
Figure 40:
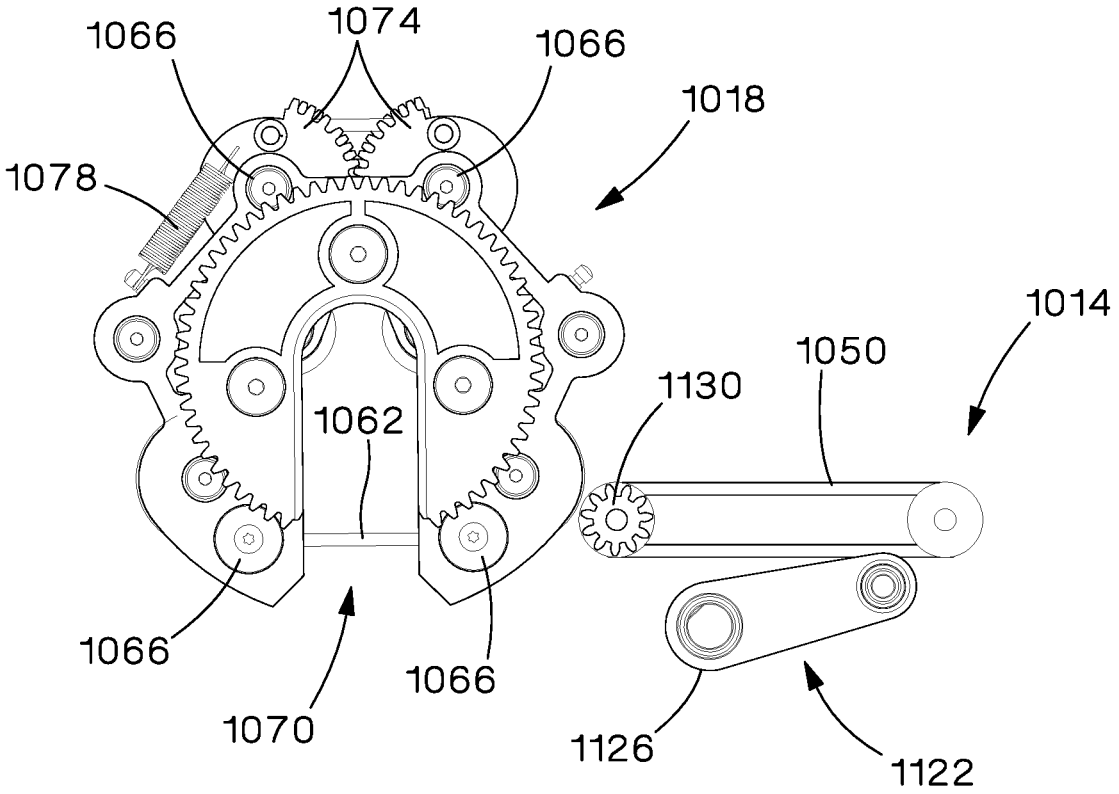
FIG. 40 is a side view of wrapping mechanism and an incoming conveyor.
Figure 41:
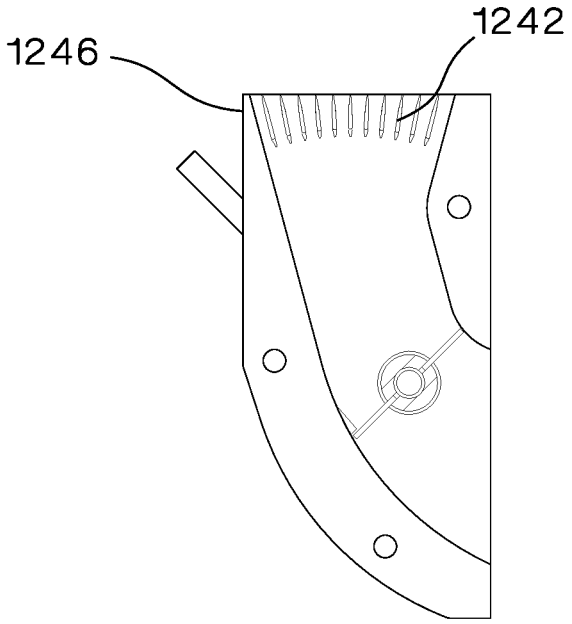
FIG. 41 is a side view of a butterfly valve.

The support box 1106 includes the suction system 1022 (see FIGS. 38 and 39). The purpose of the suction system 1022 is to hold a label 1086 against the incoming conveyor 1014 without contacting the adhesive side 1094 of the label, so that it can be carried between the printer's peel and present feature into position in the applicator head 1102.

The suction system 1022 comprises a high-flow fan 1222, a bypass valve 1226 to a control airflow diverted to an up-flow diffuser 1230 aimed at an underside of the incoming conveyor 1014, ducts 1234 to route the airflow around the cable insertion system 1110, and various support brackets. A downtube 1238 mates with a similarly shaped feature molded into the cover 1146 of the applicator head 1102 to focus a vacuum over the wrapping mechanism 1018 and the incoming conveyor 1014.

The up-flow diffuser 1230 takes some air recirculated from exhaust from the fan 1222 supported by a fan bracket 1224 and directs it up to the incoming conveyor 1014 and the applicator head 1102. It also attempts to diffuse a fluid pressure evenly over the entire distance via vanes 1242 molded across an exit 1246. This ensures the peeled label 1086 stays planted on the belt 1062 of the incoming conveyor 1014 and maintain proper orientation until adhered to the object 1082. A butterfly valve 1250 (see FIG. 39) is added to the throat of the diffuser 1230 to better control the amount of air siphoned from the fan 1222 exhaust.

Figure 42:
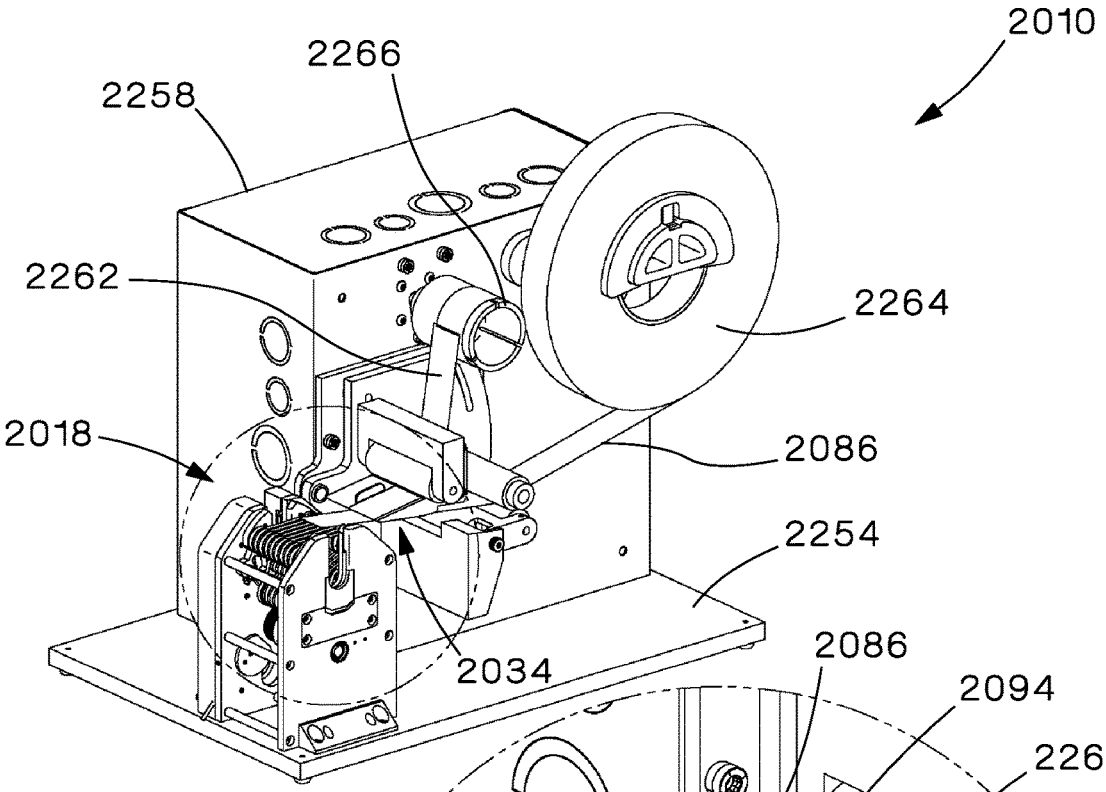
FIG. 42 is a perspective view of an apparatus of the present invention.
Figure 43:
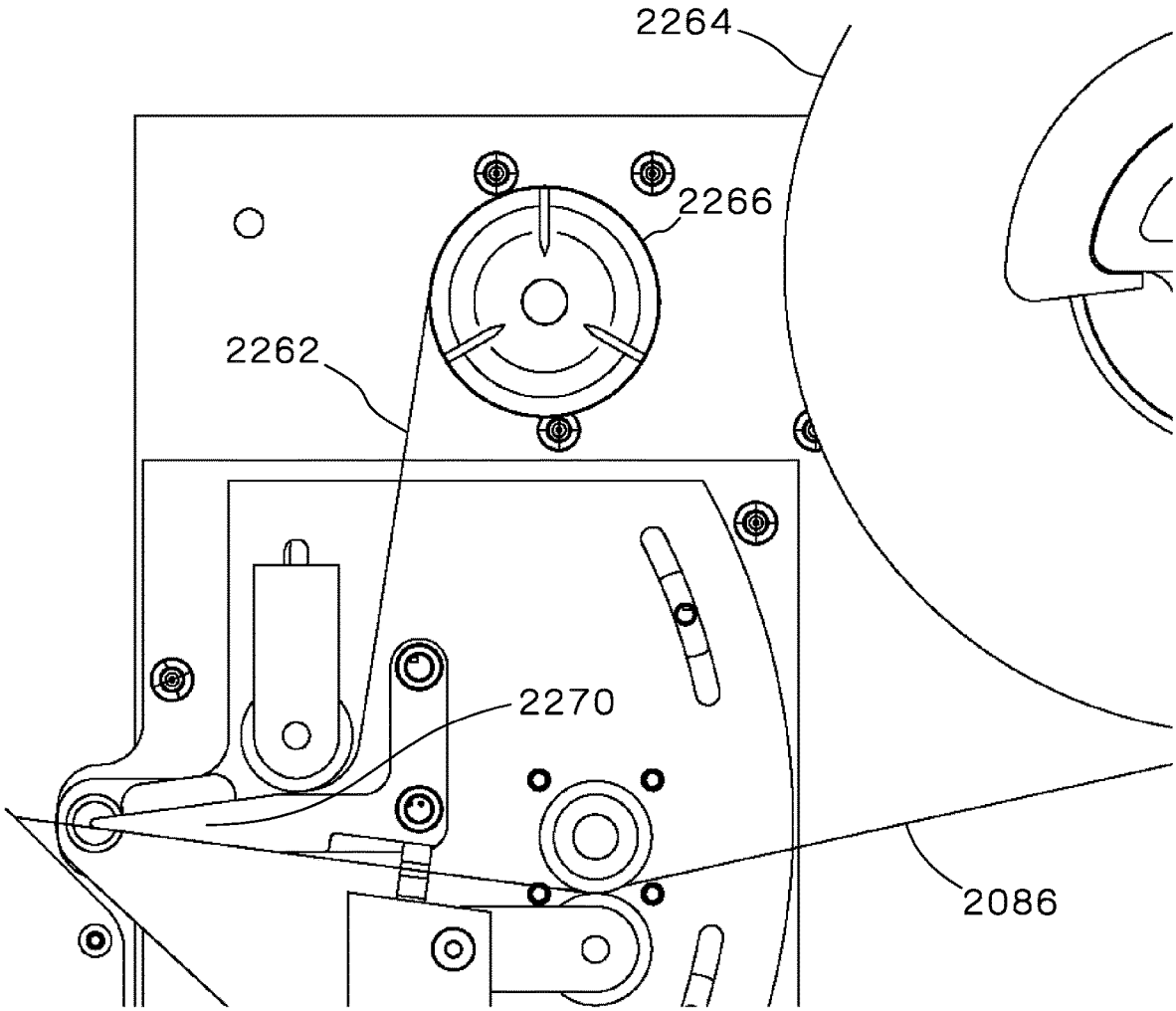
FIG. 43 is a partial side view of the apparatus of FIG. 42.
Figure 44:
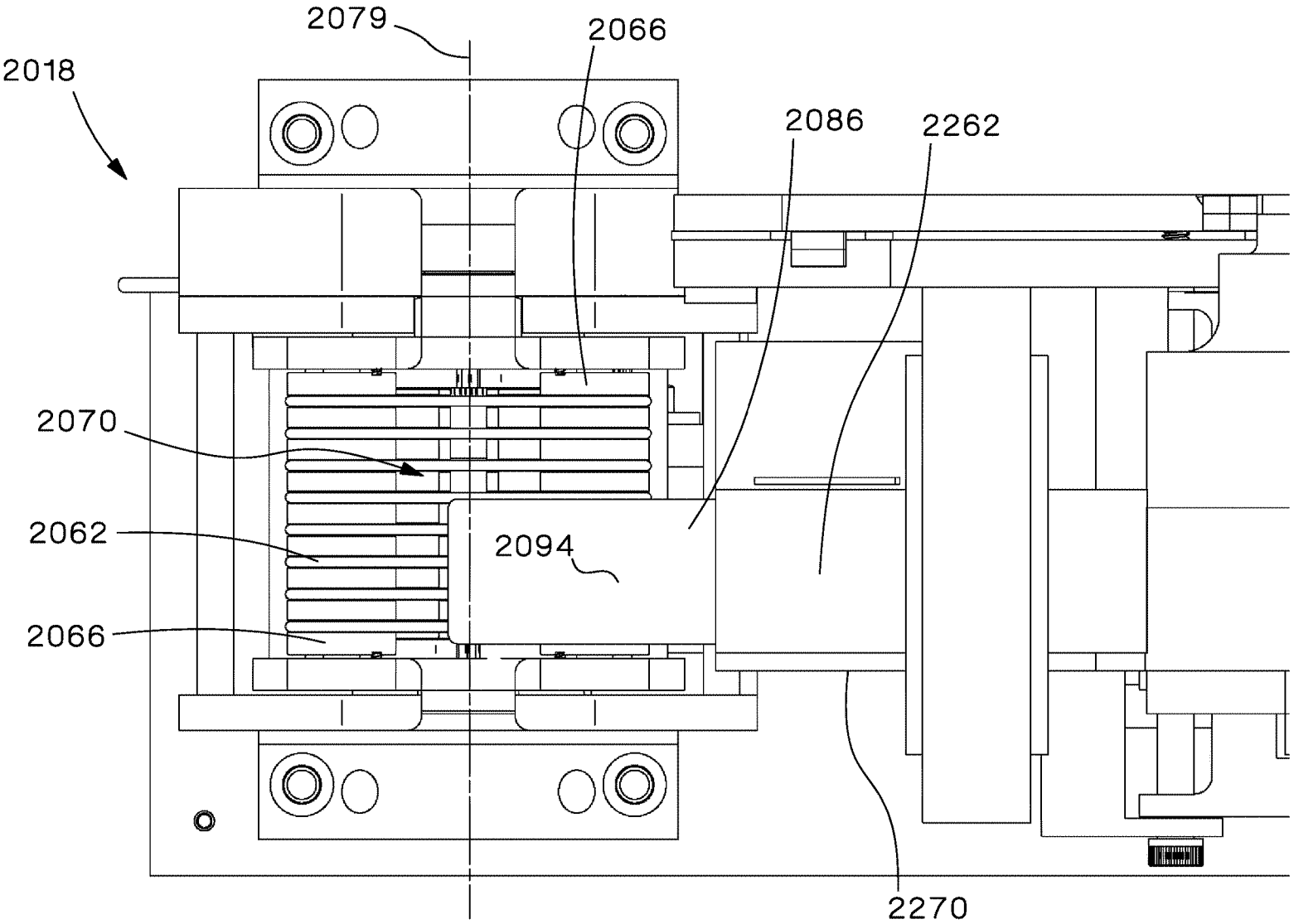
FIG. 44 is a top view of a wrapping mechanism and peel-and-present mechanism.

Referring to FIGS. 42-44, a further embodiment of a label applicator 2010 for applying pre-printed labels to objects such as wires, cables or other elongated objects of varying diameters is illustrated. The label applicator 2010 wraps the label 2086 around the objects without spinning the object along its longitudinal axis. This device is useful for label types that require that the label 2086 be wrapped around the object using more than one revolution. Self-laminating labels are one such type, requiring a transparent end of the label 2086 to be wrapped over top of the printed region to provide protection to the printed content.

The label applicator 2010 of this embodiment is a benchtop label applicator and comprises of two primary mechanisms and additional components, as shown in FIG. 42.

The wrapping mechanism 2018 and the label peel-and-present mechanism 2034 are supported on a base plate 2254 of electrical enclosure 2258. The wrapping mechanism 2018 operates substantially the same as the wrapping mechanisms 18, 1018 of the previous embodiments. The label peel-and-present mechanism 2034 contains systems to handle the unwinding, tensioning and peeling of labels 2086 as well as the rewinding of a label liner 2262.

Labels 2086 are printed in bulk off-line and wound onto a core 2264 suitable for use in the benchtop applicator 2010 with the labels 2086 facing outward. The labels 2086 and liner 2262 are loaded into the peel-and-present mechanism 2034 as shown in FIG. 43.

With the labels 2086 loaded into the peel-and-present mechanism 2034, a label liner rewind 2266 rotates and applies a tension to the liner 2262, pulling the liner 2262 and labels 2086 through the mechanism 2034 and around a peeling plate 2270. As the leading edge 2098 of the label 2086 reaches a tip of the peeling plate 2270, the label adhesive is peeled away from the liner 2262 and the label 2086 is fed, with adhesive side 2094 up, away from the central portion 2070 until the label 2086 rests on the top of the wrapping mechanism 2018.

Figure 42A:
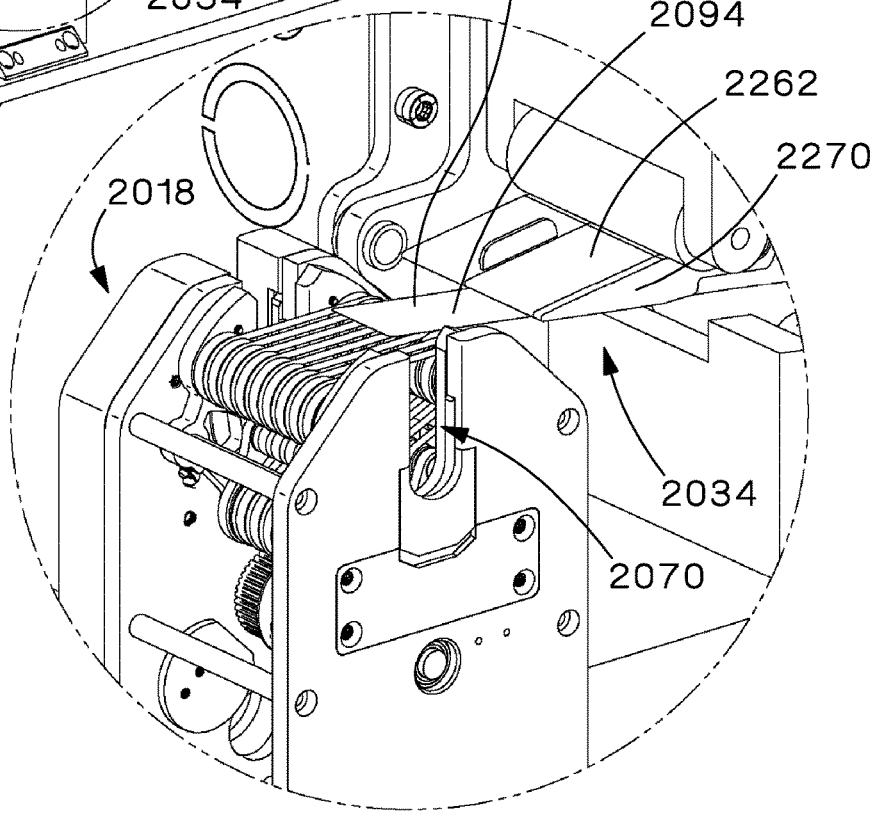
FIG. 42A is an enlarged partial perspective view of an apparatus of the present invention.

The label 2086, now positioned on the wrapping mechanism 2018 (see FIGS. 42A and 44), falls to the surface of the belts 2062 under its own weight and a small patch of the label 2086 remains attached to the liner 2262 to keep the label 2086 from moving.

Next, the object is inserted into the wrapping mechanism 2018 so that the surface of the object first contacts the adhesive side 2094 of the label 2086 traps the label 2086 between the object and the surface of the belt 2062. As the object is inserted further, the label 2086 is pressed against the object over an increasing arc length. Once the object is inserted fully, so that it is approximately at the axis of rotation 2079 of the wrapping mechanism 2018, as determined by switches or sensory means, the wrapping mechanism 2018 starts to rotate, and the label 2086 is pushed against the object from all angles as the belt 2062 moves along the surface of the object. This process is very similar to the process described in relation to the previous embodiment, with the exception that this embodiment does not include the incoming conveyor of the presence and use of the incoming conveyor.

After rotating several times to ensure that the entire length of the label 2086 has been pressed against the object, the object may be removed from the wrapping mechanism 2018.

Once removed, the process is complete and the next label is presented to the wrapping mechanism.

A further embodiment of the present invention is directed to a method of wrapping a label about an elongated object as described above in connection with the various apparatuses.

It follows that a method of applying an adhesive label to an elongated object comprising the steps of: 1) providing a source of labels wherein the source of labels comprises a label having an adhesive side with a liner thereon; 2) feeding the label from the source of labels to a wrapping mechanism; 3) contacting an object to be labeled with the wrapping mechanism; and 4) rotating the wrapping mechanism about an axis of rotation wherein the axis of rotation intersects a cross-sectional area of the object taken transverse to an elongated length of the object substantially coincident with a longitudinal axis of the object.

As explained in detail in connection with the various embodiments, the method may include inserting the object to be labeled within an opening in the wrapping mechanism prior to the rotating step. A portion of the wrapping member may be deflected inwardly into the opening in the wrapping mechanism against an elastic force during the inserting step. The label may be retained between the portion of the wrapping member and the object to be labeled during the rotating step The object to be labeled and the portion of the wrapping mechanism may remain rotationally stationary during the rotating step.

As explained in detail in connection with the various embodiments, the method may include applying a fluid pressure to the label during the feeding step to control the label during movement. The fluid pressure may be supplied by a suction system comprising a vacuum source connected by a duct to a position adjacent an incoming conveyor wherein a vacuum force provided by the vacuum source urges the label against the incoming conveyor to retain the label to the incoming conveyor.

As explained in detail in connection with the various embodiments, the method may include applying a mechanical force to the label during the feeding step to control the label during movement. The applying a mechanical force step may be provided by a conveyor assist lever actuated by a conveyor driver to operably engage an incoming conveyor and form a nip therewith through which the label travels during the feeding step.

As explained in detail in connection with the various embodiments, the method may include supporting the object to be labeled on a support and automatically transporting the object to be labeled to the wrapping mechanism via automated relative movement between the support and the wrapping mechanism. This step may be performed by an object lift mechanism comprising a cradle movable between a home position where the object to be labeled is loaded onto the cradle and wrap position where the object to be labeled is located within a central portion of the wrapping mechanism.

While the specific embodiments have been illustrated and described, numerous modifications come to mind without significantly departing from the spirit of the invention, and the scope of protection is only limited by the scope of the accompanying claims.

What is claimed is:

1. An elongated object label applicator comprising:

a first driver; and a wrapping mechanism comprising a plurality of guide rollers spaced about a central portion, a belt tensioned around the guide rollers and across an opening in the central portion through which an object to be labeled is received, the belt deflectable against an elastic force such that the belt can be recessed with the central portion by a force provided by the object to be labeled, the wrapping mechanism driven by the first driver to simultaneously rotate the guide rollers about an axis of rotation of the wrapping mechanism passing through the central portion wherein the wrapping mechanism orbits the object to be labeled located within the central portion.

2. The elongated object label applicator of claim 1 wherein the belt is freewheeling about the guide rollers.

3. The elongated object label applicator of claim 2 wherein the opening is defined between a first guide roller in the plurality of guide rollers spaced across the opening from a second guide roller in the plurality of guide rollers.

4. The elongated object applicator of claim 3 wherein a third guide roller in the plurality of guide rollers is located between the first and second guide rollers and opposite the opening, the third guide roller elastically mounted to the wrapping mechanism wherein the third guide roller is movable under a force provided by engagement between the belt and the object to be labeled which deflects the belt within the central portion of the wrapping mechanism.

5. The elongated object label applicator of claim 4 wherein a fourth guide roller in the plurality of guide rollers is located between the first and second guide rollers and opposite the opening, the fourth guide roller is elastically mounted to the wrapping mechanism wherein the fourth guide roller is movable under a force provided by engagement between the belt and the object to be labeled which deflects the belt within the central portion of the wrapping mechanism.

6. The elongated object label applicator of claim 5 further comprising:

an incoming conveyor driven by a conveyor driver, the incoming conveyor in operable alignment with the wrapping mechanism wherein a label traveling on the incoming conveyor is delivered to the wrapping mechanism; and a conveyor assist lever actuated by the conveyor driver to operably engage the incoming conveyor and form a nip therewith through which the label travels to the wrapping mechanism.

7. The elongated object label applicator of claim 6 further comprising:

an object lift mechanism comprising a cradle movable between a home position where the object to be labeled is loaded onto the cradle and wrap position where the object to be labeled is located within the central portion of the wrapping mechanism.

8. The elongated object label applicator of claim 7 further comprising:

a suction system comprising a vacuum source connected by a duct to a position adjacent the incoming conveyor wherein a vacuum force provided by the vacuum source urges the label against the incoming conveyor to retain the label to the incoming conveyor.

* * * * *